US007928361B1

(12) United States Patent
Whitehouse et al.

(10) Patent No.: US 7,928,361 B1
(45) Date of Patent: Apr. 19, 2011

(54) MULTIPLE DETECTION SYSTEMS

(75) Inventors: Craig M. Whitehouse, Branford, CT (US); David G. Welkie, Branford, CT (US)

(73) Assignee: PerkinElmer Health Sciences, Inc., Waltham, MA (US)

( * ) Notice: Subject to any disclaimer, the term of this patent is extended or adjusted under 35 U.S.C. 154(b) by 0 days.

(21) Appl. No.: 11/893,671

(22) Filed: Aug. 16, 2007

Related U.S. Application Data

(63) Continuation of application No. 10/155,191, filed on May 24, 2002, now Pat. No. 7,265,346.

(60) Provisional application No. 60/293,782, filed on May 25, 2001.

(51) Int. Cl.
*H01J 49/06* (2006.01)

(52) U.S. Cl. ..... 250/281; 250/282; 250/287

(58) Field of Classification Search ..... 250/281
See application file for complete search history.

(56) References Cited

U.S. PATENT DOCUMENTS 3,955,084 A * 5/1976 Giffin ..... 250/281
4,472,631 A * 9/1984 Enke et al. ..... 250/281
4,691,160 A 9/1987 Ino
4,894,536 A 1/1990 Conzemius ..... 250/287

(Continued)

FOREIGN PATENT DOCUMENTS

SU 851549 10/1979

(Continued)

OTHER PUBLICATIONS

Beavis, "Increasing the Dynamic Range of a Transient Recorder by Using Two Analog-to-Digital Converters," J. Am. Soc. Mass Spectrom., 7:107-113, 1996.

(Continued)

*Primary Examiner* — Phillip A Johnston
(74) *Attorney, Agent, or Firm* — Fish & Richardson P.C.

(57) ABSTRACT

A particle detection system is configured and operated as two or more separate and completely independent detection systems. The detection systems may be of the same or different design, may be operated in the same or different modes, and may be operated with the same or different operating parameters. Each detection system may record signals simultaneously, or alternately; the measurements obtained from each of the detection systems may either be combined into a single unified data set, or recorded separately. Means are provided to direct particles to impinge on one of the detectors or any of the other detectors. Alternatively, a population of particles can be dispersed in a manner that allows a population of particles to be distributed among two or more detectors simultaneously. The implementation of completely independent detection systems, for example, in a Time-of-Flight mass spectrometer, allows the design and operation of each detection system to be optimized independently, while being employed simultaneously. The flexibility afforded by the apparatus and methods in the invention allows signals to be recorded with enhanced signal dynamic range, signal-to-noise, and/or temporal resolution, relative to other presently available detection systems.

25 Claims, 11 Drawing Sheets

U.S. PATENT DOCUMENTS

| | | | | | |
|---|---|---|---|---|---|
| 5,061,850 | A | * | 10/1991 | Kelly et al. | 850/1 |
| 5,077,470 | A | * | 12/1991 | Cody et al. | 250/282 |
| 5,386,115 | A | * | 1/1995 | Freidhoff et al. | 250/281 |
| 5,463,219 | A | | 10/1995 | Buckley et al. | |
| 5,652,427 | A | | 7/1997 | Whitehouse et al. | |
| 5,654,544 | A | | 8/1997 | Dresch | |
| 5,689,111 | A | | 11/1997 | Dresch et al. | |
| 5,689,152 | A | | 11/1997 | Boutot et al. | |
| 5,712,480 | A | * | 1/1998 | Mason | 250/287 |
| 5,760,900 | A | | 6/1998 | Ito et al. | |
| 5,777,326 | A | * | 7/1998 | Rockwood et al. | 250/287 |
| 5,903,002 | A | * | 5/1999 | Turner et al. | 250/281 |
| 5,962,851 | A | | 10/1999 | Whitehouse et al. | |
| 5,981,946 | A | * | 11/1999 | Mason | 250/287 |
| 6,011,259 | A | | 1/2000 | Whitehouse et al. | |
| 6,040,575 | A | * | 3/2000 | Whitehouse et al. | 250/288 |
| 6,229,142 | B1 | * | 5/2001 | Bateman et al. | 250/287 |
| 6,300,626 | B1 | | 10/2001 | Brock et al. | 250/287 |
| 6,326,617 | B1 | | 12/2001 | Tomie et al. | 250/305 |
| 6,629,012 | B1 | * | 9/2003 | Riley et al. | 700/121 |
| 6,683,301 | B2 | | 1/2004 | Whitehouse et al. | |
| 6,781,121 | B1 | * | 8/2004 | Davis et al. | 250/287 |
| 2002/0145109 | A1 | | 10/2002 | Doroshenko | 250/287 |

FOREIGN PATENT DOCUMENTS

| | | |
|---|---|---|
| WO | WO 83/04187 | 12/1983 |
| WO | WO 01/18846 | 3/2001 |

OTHER PUBLICATIONS

Kristo and Enke, "System for simultaneous count/current measurement with a dual-mode photon/particle detector," Rev. Sci. Instrum., 59(3):438-442, 1988.

Pollard et al., "Time-Resolved Mass and Energy Analysis by Position-Sensitive Time-of-Flight Detection", Review of Scientific Instruments, 60(10):3171-3180, 1989.

Schwartz et al., "A Two-Dimensional Quadrupole Ion Trap Mass Spectrometer," J. Am. Soc. Mass. Spectrom., 13:659-669, 2002.

* cited by examiner

MULTIPLE DETECTION SYSTEMS

This application is a continuation of U.S. Ser. No. 10/155,191, Filed May 24, 2002 now U.S. Pat. No. 7,265,346, which itself claims the priority of provisional patent application Ser. No. 60/293,782, Filed May 25, 2001, the contents of both of the prior applications being incorporated herein by reference.

FIELD OF THE INVENTION

The present invention relates to the field of particle detection systems. Specifically, the present invention provides methods and apparatus for the detection and recording of intensity signals from a flux of incident particles with improved performance.

BACKGROUND OF THE INVENTION

Various kinds of detectors and signal recording technologies are employed in many different kinds of instruments for the detection and measurement of particles such as photons, electrons, ions, and neutral particles. For the purposes of the present invention disclosure, the present invention will be described with respect to the specific application as a detection system for ions in a Time-of-Flight mass spectrometer; however, it should be appreciated that the present invention is applicable and provides enhanced performance for the measurement of other types of particles in other types of apparatus, such as the detection and recording of photons in optical spectrometers.

Mass spectrometers are used to analyze solid, liquid or gaseous sample substances containing elements or compounds or mixtures of elements or compounds by measuring the mass-to-charge (m/z) values of ions produced from a sample substance in an ion source. Generally, ions are extracted from the ion source and transported into the mass spectrometer, where they are differentiated according their m/z values. The relative intensities of the differentiated m/z ions are measured with a detector and associated signal processing electronics. In a typical Time-of-Flight (ToF) mass spectrometer, ions are differentiated according to their m/z values by pulse-accelerating the population of ions in a source region to a nominally identical kinetic energy as they enter a field free flight tube. Ions of different m/z values but with a common nominal kinetic energy will have velocities that vary inversely with the square root of the m/z value. Therefore, the ion population separates spatially during their flight, and they will arrive at a detector located a fixed distance away with a time dependence that varies directly with the square root of their m/z value. The function of the ToF detector is to produce an amplified output signal that accurately reflects the relative intensities and time dependence of ions with a spectrum of m/z values as they impinge on the detector surface. The fidelity with which the detector and associated signal processing electronics are able to perform this function has a strong impact on the performance of the ToF mass spectrometer with respect to m/z resolving power, signal dynamic range, signal-to-noise, and abundance sensitivity.

A detector must satisfy a number of basic requirements in order to be viable as a detector in a ToF mass spectrometer (although such requirements may be different for other types of instrumentation, such as optical spectrometers). One of these requirements is that the detector must present a planar surface to the impinging ions. Because ions arriving at the detector of a ToF mass spectrometer are typically dispersed over some distance orthogonal to the ToF analyzer axis direction, a non-planar detector surface will produce a variation in flight distances, and therefore flight times, for ions of any particular m/z value, resulting in a degradation of the m/z resolving power. Another requirement is that the frequency response bandwidth of the detector, as well as that of the associated signal recording electronics, must be great enough to produce an output signal waveform that accurately reflects the time dependence and/or intensity of the arriving ion flux. Generally, bandwidths in the hundreds of megahertz to gigahertz range and above are required in current practice.

Still another requirement is that the detector must typically provide amplification, or 'gain', of the arriving ion current sufficient to produce a measurable output signal that corresponds to the arrival of a single ion. Often, the detector must also be capable of producing an output amplitude that is linearly proportional to many simultaneously arriving ions of any particular m/z value. Therefore, a fast analog waveform recorder, often called a fast 'analog-to-digital converter' or 'ADC', is typically employed to record the detector output amplitude as a function of time to produce the ion ToF m/z spectrum.

A variety of different types and configurations of detectors are able to satisfy these requirements to varying degrees. These include magnetic electron multipliers; discrete dynode electron multipliers; microchannel plate electron multipliers; and microchannel plate electron multipliers in combination with electron-to-photon converters, such as phosphors and scintillators, coupled to a light detector, such as a photomultiplier tube, charge-coupled device, etc. Generally, detectors of all types are limited by practical considerations in the maximum absolute amplitude of output signal that can be produced. Furthermore, over some range of signal amplitudes lower than this absolute maximum output signal, the response of the detector is typically non-linear; that is, the gain of the detector varies with signal amplitude, the gain generally declining as the signal amplitude increases. For signal amplitudes lower than this non-linear region, the gain of the detector can be relatively constant, and this range in signal amplitudes is referred to as the 'linear dynamic range' of the detector. The linear dynamic range of a detector depends on the gain; generally, as the gain of a detector is increased, the linear dynamic range decreases. Consequently, the gain of a detector is typically limited in practice to a value that is low enough to ensure that the maximum intensity in a measured ToF spectrum does not exceed the upper limit of the linear dynamic range of the detector, so that the measured spectrum accurately reflect the relative abundances of the different m/z ions in the spectrum. However, this gain is often insufficient to produce a measurable output signal from single ions or from some few ions arriving at the detector simultaneously. In order to detect such low numbers of ions arriving simultaneously, including the case of the arrival of a single ion of any particular m/z value, the gain must frequently be greater than that which prevents the maximum signal amplitude in the spectrum from exceeding the linear dynamic range of the detector. A further consideration in determining the gain that is necessary to detect the arrival of single ions is that detectors generally produce an output signal for each ion arrival, or 'hit', that can vary substantially in amplitude from hit to hit. This variation in single-ion output pulse amplitude for a detector is described by its so-called 'pulse height distribution' characteristic. The gain needs to be adjusted to a level that is high enough to ensure that as many of the single ion hits will be detected and recorded as possible. However, when detectors are operated in this condition, the largest ion intensities in a mass spectrum may produce a non-linear detector response, or even saturate the detector; that is, the incoming ion flux may become greater than that which produces the maximum possible output signal. Hence, the situation often arises in which the intensities of ions of different m/z values in a ToF mass spectrum may vary over a range that cannot be accommodated with a linear response by any detector of the prior art with any particular gain setting.

ToF m/z spectra are often measured by integrating a number of individual spectra in order to improve the overall dynamic range and signal-to-noise. For example, 100 individual spectra may be recorded at a rate of 10,000 spectra per second, and may be integrated to extend the signal dynamic range, in principle, by a factor of about 100, while also reducing any random noise in the spectrum by a factor of 10. The total time required for such a measurement would be 10 milliseconds, corresponding to a spectral acquisition rate of 100 integrated spectra per second. Nevertheless, as discussed above, the total signal dynamic range that may be achieved may be limited, in part, by the detector response characteristics when operated at a fixed gain. One approach that might, in principle, partly overcome this constraint would be to vary the gain of the detector between measurements of individual spectra. The total integrated spectrum might then exhibit greater dynamic range than if all the individual spectra were measured with a fixed gain. Unfortunately, it is usually impractical or undesirable in practice to rapidly adjust the gain of the detector from the acquisition of one spectrum to the next, because it is generally necessary to allow some time, typically on the order of milliseconds or longer, for the detector response to stabilize after the gain is changed. This delay would result in a severe reduction of the speed with which ToF spectra may be recorded, leading to a loss of sensitivity within a fixed acquisition time. Further, spectral acquisition speed is important in itself in many time-dependent analyses, such as when a mass spectrometer is used as a detector for a gas or liquid chromatographic separation, and a reduction in spectral acquisition speed would restrict the resolving power of the chromatographic separation.

When a fast ADC is used to record the output signal from the detector, the range of signal amplitudes that can be measured may also be restricted by the dynamic range characteristics of the ADC electronics. Currently available fast ADCs typically have a digitization range of 8 bits, corresponding to a full range of possible digital output values of from 0 to 255 counts. For the recording of single ion hits, it is typically necessary to adjust the gain of the detector, or that of an amplifier between the detector and the ADC input, so that single ion pulse amplitudes produce a signal at the ADC input that corresponds to several digitizer bits, on average. This is necessary in order to ensure that most of the single ion pulse amplitudes, which vary over some 'pulse height distribution', are large enough to register at least 1 bit count in the ADC conversion process. Otherwise, a significant number of single ions that produce detector output pulses with amplitudes that fall within the lower-amplitude region of the pulse height distribution, will not be recorded, resulting in substantial error in the intensities of small m/z peaks relative to that of large m/z peaks in a spectrum. However, with such a gain, the more intense peaks at other m/z values in a spectrum will often be large enough to overflow the ADC, that is, to produce a signal amplitude at the ADC input that corresponds to a digital ADC output value that is greater than 255 counts. Such saturation of the ADC may occur even for signal amplitudes that are still within the linear dynamic range of the detector itself. In this case, it is necessary to reduce the gain of the detector or signal amplifier so that the amplitude of the largest peak in the spectrum corresponds to an ADC output value less than 255 counts. Then, however, a significant number of single ion hits may not produce a signal amplitude at the ADC input that is large enough to register 1 bit count in the ADC output, resulting in substantial inaccuracies in the relative intensities of less intense m/z peaks in the measured spectrum. Hence, a compromise is often necessary when a fast ADC is used to measure ToF m/z spectra, as to whether to record ToF m/z spectra with a detector and/or amplifier gain that produces accurate relative abundances of ions with lower intensities in a spectrum, or with a detector and/or amplifier gain that produces accurate relative abundances of ions with higher intensities in a spectrum.

In an attempt to overcome the dynamic range limitations of an 8-bit ADC, Beavis reports in the J. Am. Soc. Mass Spectrom. 7, 107 (1995) an arrangement consisting of two 8-bit ADC's that simultaneously record the signal from a ToF mass spectrometer. The ToF signal is coupled to each ADC by a separate amplifier, so that the gains of the amplifiers may be different. The gain of one amplifier is set low enough so that the largest signals in the spectra do not extent beyond the 255 count limit of the first ADC, while the gain of the other amplifier is adjusted high enough to ensure that low signals, which may not have been recorded by the first ADC due to their low amplitude, are recorded by the second ADC. By combining the spectra measured with the two ADC's properly on a pulse-by-pulse basis, the dynamic range was improved by a factor of 16 relative to that of a single 8-bit ADC, corresponding in an effective amplitude resolution of 12 bits. However, the signal dynamic range is nevertheless constrained by that of the multiplier, as discussed previously, which may only be alleviated by incorporating a multiple detector arrangement, in which the multiple detectors may have different multiplier gains.

Instead of recording the signal output amplitude as a function of time with a fast analog recorder, an alternative method of recording ToF m/z spectra is often employed which essentially entails the logical detection of the arrival of ions, and recording their arrival times, with a so-called 'time-to-digital recorder', or 'TDC'. In this detection approach, the TDC only records the arrival of an ion or ions by detecting the occurrence of an output pulse from the detector at each increment in time, without regard for the amplitude of the output pulse. Typically, many TDC arrival time spectra are registered and added together to produce a histogram of the number of ions arriving as a function of flight time, which then represents the measured integrated ToF m/z spectrum. Because the amplitude of the detector output signal is not recorded in such a scheme, the detector is typically operated with the highest practical gain, resulting in greater and more uniform single-ion pulse output amplitudes than when the detector is operated in the linear 'analog' mode, as described above with a fast ADC. Consequently, a so-called 'discriminator', which only allows the detection of pulses with amplitudes above some threshold, can be employed to distinguish pulses due to ions from noise pulses. Such discrimination can result in better signal-to-noise characteristics than is typical with the fast ADC method of signal measurement. Also, with this TDC 'pulse counting' approach, the signal dynamic range depends only on the number of spectra that is practical to integrate into a single histogram spectrum, independent of the limited dynamic range characteristics of the detector itself. Therefore, this approach can result in a greater linear dynamic range than would be allowed by either the detector response characteristics when operated as a linear analog amplifier, and/or the limited bit resolution of an ADC, provided that a sufficient number of spectra are integrated.

The TDC approach offers other advantages over the fast ADC approach. Generally, TDC pulse counting electronics, which need not be burdened by an analog digitization process, can exhibit substantially better time resolution than fast ADCs. The use of a TDC can therefore result in substantially better m/z ToF resolving power than with a fast ADC, provided that other limitations to the m/z resolving power are not dominant. Another advantage of a TDC is that the amount of data produced for each spectrum is dramatically less than the data produced when an ADC is utilized. The reason for this is that a TDC produces a data value only when a detector output pulse is detected, which is typically very infrequent relative to the total number of time steps or 'bins' comprising a TDC spectrum. In contrast, a fast ADC produces a data value at every time increment over the entire duration of a spectrum measurement. Therefore, TDC data presents much less of a burden to the data processing system than that from a fast ADC.

On the other hand, the TDC approach is severely restricted in dynamic range within individual spectra, because a TDC is unable to distinguish between the arrival of a single ion and the simultaneous arrival of more than one ion. Also, TDC's typically exhibit a 'dead time' following the recording of a pulse, during which time the TDC is unable to register the arrival of any additional ions. Therefore, the use of a TDC to record m/z spectra is limited to situations in which the ion flux is low enough to ensure that the probability of arrival of more than one ion within the dead time of the TDC is less than about 0.1 for the most intense peaks in a m/z spectrum. This is necessary to ensure that very few ions are missed because they arrived too close together in time. Hence, the use of a TDC for accurate measurement of relative ion abundances is limited to analytical situations in which the ion flux is relatively low, and in which sufficient time is available to integrate enough individual spectra to achieve acceptable signal dynamic range.

A number of schemes have been developed to improve the linear dynamic range of mass spectrometer detection systems. For example, Yoichi, in U.S. Pat. No. 4,691,160, describes a discrete dynode multiplier with two collector electrodes, which are of different areas, at the output of the multiplier. Each detector may be connected to separate amplifier electronics, and one set of signal recording electronics may be connected to either of the two amplifier outputs via a switch. Each collector produces an output signal amplitude in proportion to its collection area. Also, the two separate amplifiers may operate with different gains. Therefore, depending on the amplitude of the signal, one collector/amplifier combination or the other may be selected so as to maintain the signal amplitude within the signal dynamic range of the recording electronics. This approach still limits, however, the signal dynamic range that may be accommodated within a m/z spectrum to the inherently limited linear dynamic range of the multiplier.

Kristo and Enke, in Rev. Sci. Instrum. 59 (3), 438-442 (1988), described a detector configuration for a scanning mass spectrometer that consisted basically of two channel type electron multipliers in series. An intermediate anode collector was located so as to intercept 90% of the output current from the first multiplier; the rest of the output current from the first multiplier then entered the second multiplier and was further amplified. An analog amplifier was connected to the collector of the first multiplier, and a pulse counter was connected to the collector of the second multiplier. The signal output from each of the multipliers was electronically combined to produce a composite spectrum, wherein the signal from the first multiplier was selected for intensities corresponding to more than a single ion, and the signal from the second multiplier was selected for intensities corresponding to single ions. The dynamic range that was achieved was greater than a conventional detector that employed either of these modes.

Buckley, et. al., in U.S. Pat. No. 5,463,219, described an improved method of utilizing a so-called 'simultaneous mode' electron multiplier detector in a scanning mass spectrometer. Similar to the multiple-multiplier detector structure described by Kristo and Enke, the multiplier described by Buckley, et. al., incorporates a collector electrode which is located so as to intercept a portion of the amplified current at an intermediate stage of multiplication in the multiplier structure. The remainder of the current continues the process of amplification along the rest of the multiplier structure to the final output where the current is intercepted at the final collector. The first intermediate collector was connected to an analog signal processing electronics, while the output from the final stage collector was connected to pulse counting electronics. In contrast to Kristo and Enke, however, the approach of Buckley, et. al., was to record the signals from the analog and digital outputs simultaneously. The spectra recorded by both types of recording methods were then available for processing and cross calibration after the spectra were acquired, which allowed better accuracy of peak intensities than if the choice between signal recording methods was made 'on the fly' during spectra recording.

The discrete dynode and channel electron multiplier (CEM) structures of the above prior art allow access to an intermediate stage of multiplication, at which point an intermediate collector electrode may be located in a relatively straightforward manner. However, these types of structures do not typically produce output signals with as fast a response time as that from a so-called 'channel-plate' electron multiplier (CPEM). A CPEM achieves electron multiplication over a much shorter path length, resulting in much less transit time broadening of the signal, than with the other types of detectors, which require much longer lengths for the multiplication process. Therefore, a CPEM generally results in better m/z resolving power when used as a ToF mass spectrometer detector than other types of detectors. However, because of its compact structure, it is not possible or practical to incorporate an intermediate collector electrode at an intermediate stage of multiplication. However, Soviet Inventors Certificate SU 851549 teaches the disposition of a control grid between two CPEMs. By adjusting the potential on the control grid, the overall gain of the detector assembly output can be controlled. Also, U.S. Pat. No. 5,689,152 teaches a similar control grid disposed between certain dynode sheets in an electron multiplier composing a stack of such sheets.

There have also been attempts to improve the detection capability of the TDC approach for recording simultaneously arriving ions in a ToF mass spectrometer. Rockwood and Davis describe, in U.S. Pat. No. 5,777,326, a detector configuration comprising a microchannel plate multiplier and an array of collector anodes disposed to receive the microchannel plate output current, where each collector anode receives the output current from a different area of the microchannel plate, and each collector anode is coupled to an independent discriminator and TDC counting electronics. This arrangement allows multiple ions arriving simultaneously to all be counted without loss, provided that the probability is low that more than one ion produces a signal at any one anode within the dead time of the detector and counting electronics. This approach obviously becomes very cumbersome and expensive to implement due to the multiplicity of parallel TDC counting electronics that are required. Also, the dynamic range that can be achieved in practice is constrained by the number of anodes, and by the requirement that the ion flux must be low enough to allow single ion counting with any one anode.

A somewhat different approach was described by Bateman, et. al., in U.S. Pat. No. 6,229,142 B1, which also comprised a ToF TDC-based detector consisting of a microchannel plate multiplier with multiple anodes. However, instead of a multiplicity of uniformly sized anodes, Bateman, et. al. describe a detector with multiple anodes that are of substantially different areas, each of which is connected to separate TDC electronics. Because of the difference in collection efficiency for anodes of different areas, the signal from one anode or another may be selected according to the anode that produces the most valid results, depending on the signal intensity. The dynamic range that may be realized with this configuration is improved over that of a single anode with a TDC, but, obviously, the dynamic range of this approach is nevertheless constrained by the fact that no more than one ion may be counted for each anode, as with the multi-anode configuration of Rockwood and Davis.

SUMMARY OF THE INVENTION

It is an object of the present invention to provide methods and apparatus that provides for the recording of particle signals with a greater dynamic range than prior detection systems.

It is another object of the present invention to provide methods and apparatus for the recording of particle signals with improved temporal resolving power and measurement accuracy compared to prior detection systems.

It is another object of the present invention to provide methods and apparatus for the recording of particle signals with improved signal-to-noise ratio.

It is another object of the present invention to provide a time-of-flight mass spectrometer and detection system therefore, which has a greater dynamic range than prior apparatus. It is a further object of the present invention to provide methods for operating such a spectrometer and detector in order to achieve greater dynamic range than prior apparatus.

It is another object of the present invention to provide a time-of-flight mass spectrometer and detection system therefore, which has a greater temporal resolving power and measurement accuracy than prior apparatus. It is a further object of the present invention to provide methods for operating such a spectrometer and detector in order to achieve greater temporal resolving power and measurement accuracy than prior apparatus.

It is another object of the present invention to provide a time-of-flight mass spectrometer and detection system therefore, which has a greater signal-to-noise ratio than prior apparatus. It is a further object of the present invention to provide methods for operating such a spectrometer and detector in order to achieve greater signal-to-noise ratio than prior apparatus.

According to one embodiment of the present invention there is provided a time-of-flight mass spectrometer.

A detection system is provided that comprises two or more completely separate and independently controllable detectors, each of which is coupled to separate and independent signal processing and recording electronics. Said detectors may consist of collection plates or anodes, which directly receive particles to be measured, such as ions in a time-of-flight mass spectrometer. Preferably, however, particles to be measured are first amplified by particle multiplication means in each detector, such as a so-called channel-plate electron multiplier, the output electrons from which are collected by said collection anodes. Each detector may include such a multiplier that is separate and independent from the multipliers of all other detectors. Therefore, each detector may operate with a degree of amplification, or 'gain', that is different from that of all other detectors. Each detector may also include a so-called 'conversion dynode', which the particles to be measured first hit, and the secondary particles produced by such impacts are directed to the collection anodes, or, preferably, to the multiplier included within the detector. Each detector may have one or more than one collection anodes associated with it. If a particular detector has more than one collection anode, the collection anodes may be of equal collection areas, or they may be of different collection areas. The collection anodes of each detector may also be the same shape or they may be of different shapes. Each collection anode may be coupled to signal processing and recording electronics that is completely separate and independently controlled relative to that of any other collection anode, either within any one detector, or among the collection anodes of all detectors.

Because the signal processing and recording electronics coupled to each collector anode are separate and independent, the signal processing and recording electronics coupled to any one collector anode may be operated completely differently from any other such electronics coupled to any other collector anode, and, in fact, the electronics coupled to any one collector anode may be of entirely different technology than that of any other collector anode electronics.

One type of the signal processing and recording electronics technology may consist, for example, of signal amplification electronics combined with a fast analog-to-digital (ADC) electronics; digital memory array in which to store a digitized spectrum and to integrate a number of digitized spectra; and a computer with associated memory arrays for processing and storage of such digitized spectra. Another type of signal processing and recording electronics technology may consist of, for example, signal amplification electronics coupled with signal discrimination electronics, which distinguishes signal from noise; coupled to a time-to-digital converter (TDC) electronics, which registers the flight time of ions in the ToF spectrometer in an associated histogram memory array; and a computer with associated memory arrays for processing and storage of such histogram spectra. Other types and configurations of signal processing and recording electronics are also possible.

In one preferred embodiment of the present invention, a multiple-detection system is provided in which at least one detector consists essentially of: one or more channel electron multipliers arranged in cascade to achieve substantial amplification of the ion signal, and a single collection anode which is coupled to a signal amplifier and a fast ADC and data acquisition system; and in which at least one other detector consists essentially of: one or more channel electron multipliers arranged in cascade to achieve substantial amplification of the ion signal, and a single collection anode which is coupled to a signal amplifier, a discriminator, and a TDC and data acquisition system. The fast ADC detection system allows ToF m/z spectra to be measured and recorded for m/z values with more than one simultaneously-arriving ions, while the TDC detection system allows efficient detection and measurement of m/z values with only single-ion hits. In a preferred method of operation with this embodiment, the gain of the multiplier of the at least one detector coupled to a TDC system may be set to the maximum safe operating level so as to produce output pulse amplitudes that are relatively large and more uniform in amplitude than would be the case with lower gain settings. This detection arrangement is thereby optimized for recording of single ion hits within the spectrum of m/z ions under measurement. Also in this preferred method of operation, the gain of the at least one other detector with the fast ADC may be adjusted to a lower level that is optimum for detection and measurement of more abundant m/z ions for which more than one ion arrives simultaneously at the detector. Therefore, the gain of this at least one other detector may be set to a level that is lower than would be required for the efficient detection of single ion hits, and thus, the linear dynamic range of this multiplier may be extended to greater signal amplitudes than would be possible if this at least one other detector was required to detect single ion hits. By combining the information contained within the spectra from each of these two detection systems, a composite spectrum results that has a signal dynamic range greater than that from either single detection system. Also, the precision with which ion flight times are measured can be greater with state-of-the-art TDC acquisition systems than with state-of-the-art ADC acquisition systems. The more precise measurement of ion flight times for relatively low intensity ions may be used to improve the m/z resolving power of the total composite spectrum, at least for low-intensity ions for which less than one ion arrives at the detector for any one spectrum. Nevertheless, the better time measurement precision afforded by the TDC acquisition systems, even if only for low-intensity ions, can be utilized to establish a more accurate calibration between the arrival times of all ions and their m/z values, while simultaneously allowing a greater dynamic range than is possible with the prior art. Another benefit of this embodiment is that the low-intensity signals may be recorded with the better signal-to-noise characteristics of the TDC acquisition systems than is typically possible with a fast ADC acquisition system, while maintaining the capability to accurately measure greater intensity signals, resulting in a composite spectrum with better dynamic range and signal-to-noise simultaneously.

In another preferred embodiment of the present invention, a multiple detector arrangement is provided in which any of the detectors is provided with a single anode or multiple anodes, each anode of which is coupled to a separate TDC acquisition system. Single detectors with multiple-anode configurations are described, for example, in U.S. Pat. No. 5,777,326 for anodes of equal area, or in U.S. Pat. No. 6,229,142 for anodes of unequal areas. Such configurations extend the signal dynamic range that can be achieved with TDC acquisition systems while retaining the potentially superior time resolving power and signal-to-noise characteristics of TDC acquisition systems relative to fast ADC acquisition systems. However, the dynamic range of any one TDC acquisition system is limited to substantially less than one ion hit in any one spectrum acquisition because TDC's cannot distinguish between detector output pulses due to one ion from pulses due to the simultaneous arrival of more than one ion. Therefore, in order to accommodate a relatively large number of simultaneously arriving ions with a single detector containing multiple anodes, the number of anodes must be large enough, and the detection area corresponding to any one anode must be small enough, so that any one anode does not detect a single ion arrival more than about 10% of the time for any one ion m/z value. For intense ions, this may require a relatively large number of anodes, which, in a single detector, implies that the anode areas may become small and close together. The implementation of such a structure, without introducing signal interference between anodes and their signal transmission pathways, may become technically challenging and therefore prohibitively costly. A more practical approach is to disperse the ion flux across a wider detector area, which would allow the same number of anodes with the same detection rate, but with anodes that are larger in area and therefore more practical and economical to implement. One disadvantage of this approach, however, is that a multiplier with a larger area would be required. Multipliers, such as microchannel plates, generally become prohibitively expensive to manufacture in larger sizes, and so may not be economical in many applications. Also, it is generally not possible to manufacture large microchannel plate multipliers with the same degree of flatness as smaller microchannel plates, which is important for achieving good m/z resolving power in a ToF mass spectrometer. Therefore, a multiple detector arrangement according to this embodiment of the present invention, in which the different multipliers may each contain one or a multiple number of collector anodes, each of which is coupled to a separate TDC acquisition system, may be more economical in configurations with a relatively large number of anodes, relative to a large single detector of the same effective detection area and anode number, while also providing potentially better time resolving power, due to superior detector surface flatness of multipliers with smaller dimensions, in a ToF mass spectrometer.

In another preferred embodiment of the present invention, a multiple-detector arrangement is provided in which at least one of the detectors is provided with multiple anodes, each of which is coupled to a separate TDC acquisition system. Multiple-anode detectors are described, for example, in U.S. Pat. No. 5,777,326 for anodes of equal area, or in U.S. Pat. No. 6,229,142 for anodes of unequal areas. Such configurations extend the signal dynamic range that can be achieved with TDC acquisition systems while retaining the potentially superior time resolving power and signal-to-noise characteristics relative to fast ADC acquisition systems. However, the number of anodes that can be employed within practical and/or economical restrictions nevertheless limits the dynamic range achievable with such multiple-anode TDC configurations. For example, multiple-anode TDC configurations require that the clocks or timers of all TDC electronics be synchronized to a precision at least as good as the precision of the clocks; otherwise, the overall time resolution of the resulting spectrum will be degraded. Such time synchronization becomes increasingly more difficult as the number of TDC systems increases. Also, each set of TDC electronics adds additional cost to the system, so the multiplicity of anodes and TDC acquisition systems may be limited by economical considerations. In this embodiment of the present invention, the number of multi-anode TDC systems is limited to a practical, economical number, and at least one other detector is employed to measure and record ion signal amplitudes in parallel with the TDC measurements using a fast ADC and associated electronics system. This at least one other detector may be operated with a lower multiplier gain which allows accurate measurement of a range of signal amplitudes that overlaps with, but extends to much greater signal amplitudes than, the dynamic range of the detector or detectors with the multiple anodes and TDC acquisition systems. Therefore, such a multiple-detector combination according to this embodiment of the present invention provides substantially greater dynamic range, than that of prior art practical, single detectors with either multiple anodes and TDC acquisition systems, or with a single anode and an ADC acquisition system. Furthermore, such a multiple-detector combination according to this embodiment of the present invention provides substantially better time resolving power and signal-to-noise, as discussed above, compared to that of prior art single detectors with either multiple anodes and TDC acquisition systems, or with a single anode and an ADC acquisition system.

In other preferred embodiments of the present invention, a multiple-detector arrangement is provided in which at least one detector may be provided with multiple anodes. In the at least one detector with multiple anodes, at least one of the anodes is coupled to a fast ADC and associated electronics, and at least one other anode is coupled to a separate TDC and associated electronics. The gain of the multiplier of this detector may be optimized for the highest range of signal amplitudes, or the lowest range of signal amplitudes including single ion hits, or some range of signal amplitudes intermediate between these highest and the lowest ranges of signal amplitudes. This detector, within the range of the ADC, may measure signal amplitudes accurately, while time information may be measured more precisely for these signals by the TDC acquisition system(s). At least one other detector in these particular embodiments of the invention may be configured with at least one anode. In one particular embodiment, one anode of the at least one other detector is coupled to a separate fast ADC acquisition system. The gain of the multiplier of each of these at least one other detector may be optimized for the signal amplitude range not completely included within the range of other detectors. The dynamic range of the composite spectrum, which results from combining the spectra from each ADC acquisition system, is therefore greater than would be possible with prior single detection systems. Preferably, other anodes of the at least one other detector are coupled to separate TDC acquisition systems, which may be used to measured time information more precisely than the ADC acquisition systems, each coupled to one anode of the at least one other detector. The gain of one of these detectors may be optimized for detection of single ion hits, and the TDC acquisition systems associated with this detector may also be utilized to provide accurate intensity information for these single ion signals, that is, where less than 0.1 ion hit is registered per spectrum on any one anode, as well as to provide better signal-to-noise for these signals, than is possible with typical fast ADC acquisition systems.

In another preferred embodiment of the present invention, a multiple detection system is provided that consists of at least two separate and independently controlled detectors, each of which includes a single collector anode coupled to a separate and independently controlled fast ADC and associated signal processing and recording electronics. The gain settings of each detector may be optimized for different ranges of signal levels, for example, one detector and amplifier may be optimized for the most intense ion signals, while the gain settings of at least one other detector and amplifier may be optimized for less intense ion signals, and/or the gain settings of one other detector and amplifier may be optimized for single ion signals. By combining the spectra produced by each detection system into a composite total spectrum, a dynamic range may result that is greater than that from any single detection system of the prior art.

In another preferred method of the present invention, a multiple detection system is provided that consists of at least two separate and independently controlled detectors, where each detector may contain one or more collector anodes. Each anode of each detector is coupled to a separate and independent amplifier, each of which may provide a different gain or signal amplification. The outputs of such amplifiers from at least one detector may then be coupled to separate and independently controlled fast ADC acquisition systems. The outputs of the amplifiers coupled to other anodes associated with other detectors may also be coupled to separate ADC systems, and/or, to separate TDC acquisition systems. One situation in which this embodiment of the present invention is advantageous is when the signal dynamic range of a detector configured with multiple anodes exceeds the dynamic range of the ADC acquisition systems. For example, the gain of one amplifier coupled to one of the anodes from such a detector may be set relatively low so as to allow the ADC to measure the largest signal amplitudes in the spectra, while the gains of other amplifiers coupled to other anodes of the same detector may be adjusted to some higher gain levels in order to measure signals in the spectra with lower amplitudes with the respective other ADC acquisition systems. By combining the spectra produced by each detection system into a composite total spectrum, a dynamic range may result that is greater than that from any single detection system of the prior art.

The population of particles comprising each spectrum to be measured, such as ions in a ToF mass spectrometer, may be distributed homogeneously and simultaneously across all, or any subset of, detectors. One preferred method of achieving homogeneous spatial dispersion across multiple detectors is to pulse accelerate a homogeneous spatial distribution of ions from the pulse acceleration region of an orthogonal acceleration ToF mass spectrometer, which injects a segment of a homogeneous ion beam into the flight tube. A less preferred method of achieving a spatial dispersion of ions across multiple detectors is to allow an initial population of ions pulse accelerated into a ToF mass spectrometer to disperse spatially as they traverse the ToF mass spectrometer, for example, due to initial kinetic energy variations in the initial ion population, or due to scattering effects in the ToF optics such as from grids, gas molecules, electric field inhomogeneities, etc. The result is that the collection of ions is distributed homogeneously across both detectors of a dual- or multiple-detector arrangement for any particular spectrum acquisition; therefore, the signal from either detector is representative of the relative abundance of different m/z ions in the sampled ion population.

In another preferred method of distributing a population of ions across multiple detectors simultaneously according to the present invention, a collection of ions that is pulse accelerated into an orthogonal acceleration ToF mass spectrometer is arranged to develop a spatial distribution that depends on the ion mass-to-charge (m/z). An m/z-dependent spatial distribution along the axis of the initial ion beam entering the pulse acceleration region of an orthogonal acceleration ToF mass spectrometer may result, for example, from direct sampling of the ion population emanating from a supersonic expansion. The velocity distributions of ions of all m/z values are similar in such a supersonic expansion, so larger m/z values will travel a greater distance along the initial ion beam axis in the direction of the detector region because they take longer to traverse the ToF spectrometer. Another preferred method of achieving an m/z-dependent spatial distribution of ions in the initial ion population is to pulse extract ions over a short time period from an ion source or an ion storage region and to direct them into the pulse acceleration region of an orthogonal acceleration ToF mass spectrometer. Typically, the pulse extraction of ions from such ion populations causes all extracted ions to acquire the same nominal kinetic energy. As the extracted ions traverse the distance from the ion source or storage region to the pulse acceleration region of an orthogonal acceleration ToF mass spectrometer, ions of greater m/z values travel slower than lighter m/z ions, resulting in a m/z separation in the ion beam by the time the ion population fills the ToF pulse acceleration region and is pulse accelerated into the ToF mass spectrometer. The dispersion of different m/z values along the initial extracted ion beam axis continues as the ions traverse the ToF flight tube, so that ions of lower m/z values arrive at the detector region farther away from the pulse acceleration region than ions of larger m/z values. In this preferred method of the present invention, a multiple-detector arrangement is provided in which one or several detectors is positioned to detect ions of lower m/z values of an ion population dispersing in the initial ion beam direction, as described above, while the second and/or subsequent detector(s) may be located so as to detect ions of greater m/z values. One advantage of the multiple detection system of the present invention relative to the prior art is that a larger detection area is available with which to detect and measure a larger range of such m/z-dispersing ions. A single detector of the prior art may, in principle, be large enough to cover the same area, hence the same m/z range as two or more smaller detectors, but, because the cost of detectors generally increases dramatically with their size, it is usually more cost effective to provide two or more smaller detectors to provide the same detection area as one large detector. Another significant advantage of the multiple detector arrangement of the present invention is the flexibility which a multiple-detector arrangement provides to optimize the detection and measurement of ions in the different segments of the m/z spectrum that arrive at the two or more different detectors. For example, the intensities of ions of larger m/z values are often lower than the intensities of ions of smaller m/z values. Therefore, for a population of ions that are m/z-dispersing in a direction orthogonal to the ToF pulse acceleration direction, the detector that receives the larger m/z ions may be operated with a larger gain, and/or may be coupled to a single or multi-anode TDC if the intensities are low enough, in contrast to the detector(s) that receives the greater intensity, lower m/z ions, which may require a relatively low gain, and/or a fast ADC, because of their greater intensities. Therefore, the generally lower-intensity, higher m/z ions may be measured with better signal-to-noise with the multiple detector arrangement of the present invention than with the prior art single detector configurations in which the operating conditions were constrained in order to accommodate the lower m/z ions, as well as the high m/z ions.

In another preferred method of the present invention, ions may be directed to impact one of the detectors exclusively of a multiple detector arrangement for any one spectrum. For example, in accordance with one preferred method of the present invention, ions may be directed to impact one of the detectors of a multiple detector arrangement or another by electrostatic deflection of the ions in the ToF flight tube, using electrostatic deflectors that are well known in the art. In accordance with another preferred method of the present invention, ions may be directed to impact one of the detectors of a multiple detector arrangement or another by changing the kinetic energy with which they enter the pulsing region of an orthogonal acceleration ToF mass spectrometer. By increasing this kinetic energy, ions will travel a greater distance along a direction orthogonal to the axis of the ToF acceleration axis, and the ions will arrive at the detector region farther away from the pulse region than lower energy ions. Therefore, by properly adjusting the kinetic energy of the ions prior to their pulse acceleration into the ToF analyzer, they can be made to arrive at one detector or another, provided that the detectors are separated in space along the initial ion beam axis.

Regardless of whether ions are distributed in space across a plurality of detectors, or whether ions are directed to impact one detector exclusively or another, the signals at the anodes of every detector may or may not be measured and/or recorded by the respective signal processing and acquisition systems simultaneously. For those preferred embodiments of the present invention, in which each anode of every detector is directly coupled to completely separate and independent signal processing and recording acquisition systems, signals from each anode may be recorded simultaneously for each spectrum. Alternatively, the signals from some or all of the anodes from some or all detectors of a multiple-detector arrangement may instead be processed and recorded alternately, that is, the signals from one anode may be recorded and perhaps integrated over some period of time, and then the signals from another anode may be processed and recorded for some period of time, and so on for the signals at other anodes. In those applications in which this alternate method of measuring m/z spectra is sufficient, other preferred embodiments of the present invention may be advantageous with respect to cost and complexity. In one of these preferred embodiments, the signals from each of the collector anodes may be routed through a common signal processing electronics and a common signal recording electronics. The gains of any amplifiers in the signal pathways may nevertheless be changed to different values from the recording of signals from one anode to the subsequent recording of signals from another anode. Alternatively, the signals from each of these anodes may be processed by their separate and independently controlled signal processing electronics, with possibly different amplifier gains, and then routed via fast analog switches to a common signal recording electronics. The primary advantage of these preferred embodiments is reduced cost and complexity, because multiple electronics systems that are redundant from one anode to another are eliminated by such signal multiplexing from one anode to another.

In another preferred method of the present invention, the number of spectra that are accumulated to produce a net integrated spectrum from each anode of a multiple-detector arrangement may be different for each detector. For example, a detector and associated electronics that is optimized to record low intensity signals may integrate a greater number of spectra than the detector and associated electronics of the other detector which is optimized for signals with greater intensities. For the situation in which the detectors are used alternately, rather than simultaneously, and the total integration time is divided between the two detectors, a better signal-to-noise is achieved than if each detector integrated the same number of spectra.

DETAILED DESCRIPTION OF THE INVENTION AND THE PREFERRED EMBODIMENTS

Time-of-Flight (TOF) mass analyzers that incorporate a linear or an orthogonal pulsing region as a means for pulsing ion bunches into the ToF tube are well known to those skilled in the art. Orthogonal pulsing Time-of-flight (O-TOF) mass analyzers are typically configured with the ion source located external to the TOF pulsing region. The primary beam of ions exiting an ion source is directed into the pulsing region of the TOF with a trajectory oriented substantially orthogonal to the axis of the Time-of-flight tube drift region. Several types of ion sources can be interfaced with orthogonal pulsing Time-of-flight mass analyzers. These include but are not limited to Electron Ionization (EI), Chemical ionization (CI), Photon and Multiphoton Ionization, Fast Atom Bombardment (FAB), Laser Desorption (LD), Matrix Assisted Laser Desorption (MALDI), Thermospray (TS), sources as well as Atmospheric Pressure Ion (API) sources including Electrospray (ES), Atmospheric Pressure Chemical Ionization (APCI), Pyrolysis and Inductively Coupled Plasma (ICP) sources. Orthogonal pulsing time-of-flight mass analyzers have been configured in tandem or hybrid mass spectrometers. Ions can be delivered to the time-of-flight orthogonal pulsing region from several mass analyzer types including but not limited to multipole ion guides including quadrupoles, hexapoles or octopoles or combinations thereof, triple quadrupoles, magnetic sector mass analyzers, ion traps, time-of-flight, or Fourier transform mass analyzers. Hybrid or tandem instruments allow one or more steps of mass to charge selection or mass to charge selection with fragmentation (MS or MS/MS") combined with orthogonal pulsing Time-of-flight mass analysis.

Ions may be pulsed directly into the drift region of the time-of-flight mass spectrometer, or they may be trapped and accumulated for some period of time, and/or undergo collisional fragmentation, in the pulsing region due to the action of a pseudo-potential well that may be incorporated in the pulsing region, as described in co-pending application by the same inventors, titled "Charged Particle Trapping in Near Surface Potential Wells". Ions that are pulse accelerated into the ToF drift region may arrive directly at a detector region, where they are detected and recorded. This configuration is commonly referred to as a "linear ToF mass spectrometer". Alternatively, the ions may be reflected by an electrostatic mirror, well-known to those skilled in the art and commonly referred to as a "reflectron" mirror, after traversing the drift region. Upon reflection in the mirror, the ions then traverse the drift region again before arriving at the detector region. This configuration of a time-of-flight mass spectrometer is commonly referred to as a "reflectron ToF mass spectrometer".

Figure 1:
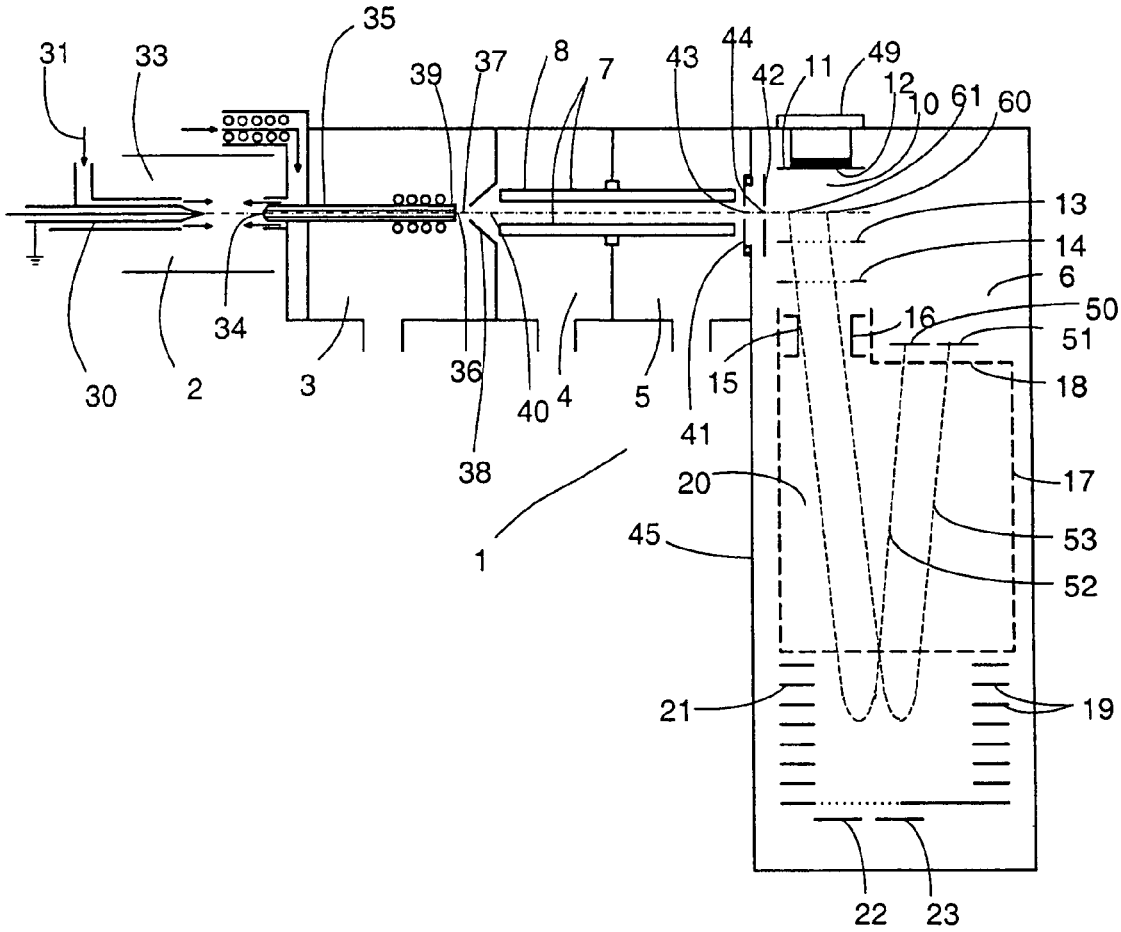
FIG. 1 is a diagram of one embodiment of the invention, comprising a hybrid orthogonal pulsing ToF mass analyzer configured with an Electrospray ion source, an ion guide and transfer optics, and a dual detector system, in which an ion population is distributed between the two detectors of the dual detector system.

One preferred embodiment of the invention is the configuration of an orthogonal Time-of-flight mass spectrometer that incorporates a multiple-detector arrangement for detecting and recording the intensities and arrival times of ions at the end of their flight through the spectrometer, as shown in FIG. 1 for a hybrid reflectron ToF mass spectrometer. FIG. 1 is a diagram of an orthogonal pulsing ToF mass analyzer that incorporates two dual detector arrangements: one dual detector arrangement that includes detectors 22 and 23, and the other dual detector arrangement that includes detectors 50 and 51. Although two dual detectors are illustrated in FIG. 1, either or both of the dual detector arrangements could just as well be detector arrangements consisting of three or more detectors. The hybrid orthogonal ToF mass spectrometer depicted in FIG. 1 is also configured with an Electrospray (ES) ionization source and a multipole ion guide ion trap. The multipole ion guide that extends continuously into multiple vacuum pumping stages can be operated in RF only, mass-to-charge selection or ion fragmentation mode as described in U.S. Pat. Nos. 5,652,427; 5,689,111; 6,011,259; and 5,962,851. The instrument diagrammed can be operated in MS or MS/MS" mode with gas phase collisional induced dissociation (CID). Hybrid ToF mass analyzer 1 diagrammed in FIG. 1 includes Electrospray ion source 2, four vacuum pumping stages 3, 4, 5 and 6 respectively, multipole ion guide 8 that extends into vacuum pumping stages 4 and 5, orthogonal ToF pulsing region 10 including pusher electrode 11 with pusher electrode surface 12, ToF drift region 20, single stage ion reflector or mirror 21 and detectors 22 and 23, and detectors 50 and 51. Liquid sample bearing solution is sprayed into Electrospray source 2 through needle 30 with or without pneumatic nebulization assist provided by nebulization gas 31. The resulting ions produced from the Electrospray ionization in Electrospray chamber 33 are directed into capillary entrance orifice 34 of capillary 35. The ions are swept though capillary 35 by the expanding neutral gas flow and enter the first vacuum stage 3 through capillary exit orifice 36. A portion of the ions exiting capillary 35 continue through skimmer orifice 37 and enter multipole ion guide 8 at entrance end 40 located in the second vacuum pumping stage 4. Ions exiting ion guide 8 pass through orifice 43 in exit lens 41 and through orifice 44 of focusing lens 42 and are directed into pulsing region or first accelerating region 10 of ToF mass analyzer 45 with a trajectory that is substantially parallel to the surface of planar electrodes 11, 12 and 13. The surfaces of planar electrodes 11, 12 and 13 are positioned perpendicular to the axis of ToF drift tube 20. Pusher electrode surface 12 is configured as part of pusher electrode 11 and counter or ion extraction electrode 13 is configured with a high transparency grid through which ions are accelerated into ToF drift region 20. The gap between pusher electrode 11 with pusher surface 12 and counter electrode 13 defines the orthogonal pulsing or first accelerating region 10.

During orthogonal pulsing TOF operation, a substantially neutral or zero electric field is maintained in pulsing region 10 during the period when ions are entering the pulsing region from multipole ion guide 8. At the appropriate time, an accelerating field is applied between electrodes 11 with surface 12 and electrode 13 to accelerate ions into ToF tube drift region 20. During the initial ion acceleration and subsequent ion flight period, the appropriate voltages are applied to lenses 11, 13, 14, steering lenses 15 and 16, flight tube 17, ion reflector electrodes 19, post accelerating grid 18 and detectors 50 and 51 to maximize ToF resolving power and sensitivity. Ions pulsed from the ToF first accelerating region 10 may be directed to impact on detectors 22 and 23 or detectors 50 and 51 depending on the analytical result desired. If the pulsed ion beam is steered with steering lenses 15 and 16, detectors 22 and 23 or detectors 50 and 51 can be tilted as is described in U.S. Pat. No. 5,654,544 to achieve maximum resolving power. Prior to entering ToF pulsing region 10, the original ion population produced by Electrospray ionization may be subjected to one or more mass selection and/or fragmentation steps. Ions may be fragmented through gas phase collisional induced dissociation (CID) in the capillary skimmer region by applying the appropriate potentials between the capillary exit electrode 39 and skimmer 38. In addition, the analytical steps of ion trapping and/or single or multiple step mass to charge selection with or without ion CID fragmentation can be conducted in multipole ion guide 8 as described in U.S. Pat. No. 5,689,111 and U.S. patent application Ser. No. 08/694,542. Said mass selection and CID fragmentation steps are achieved by applying the appropriate RF, DC and resonant frequency potentials to rods or poles 7 of multipole ion guide 8. A continuous or gated ion beam of the resulting ion population in multipole ion guide 8 can be transmitted into ToF pulsing region 10 from ion guide 8 through lens orifices 43 and 44 in electrodes 41 and 42, respectively.

As indicated in the preferred embodiment of the present invention depicted in FIG. 1, a segment of the ion beam between 60 and 61, traversing the orthogonal acceleration region 10, is pulse accelerated into the ToF drift region 20. The ion beam segment defined by end points 60 and 61 traverses the drift region, is reflected in the reflectron 21, and traverses the drift region 20 again before arriving at the detectors 50 and 51. The trajectory followed by the ion beam segment is illustrated in FIG. 1 by the trajectory paths 52 and 53 for the end points 60 and 61, respectively. All ions within beam segment between end points 60 and 61 follow trajectories between and substantially parallel to trajectories 52 and 53 through the time-of-flight mass spectrometer regions. As illustrated in FIG. 1, a portion of the ion beam segment between 60 and 61 impacts detector 50, while another portion of ion beam segment between 60 and 61 impacts detector 51. If the ion beam segment is relatively homogeneous, then the m/z distribution of ions reaching detector 50 will be the same as that reaching detector 51, and the signal from either detector will accurately represent the m/z distribution in the ion beam segment 60, 61, simultaneously.

Figure 2:
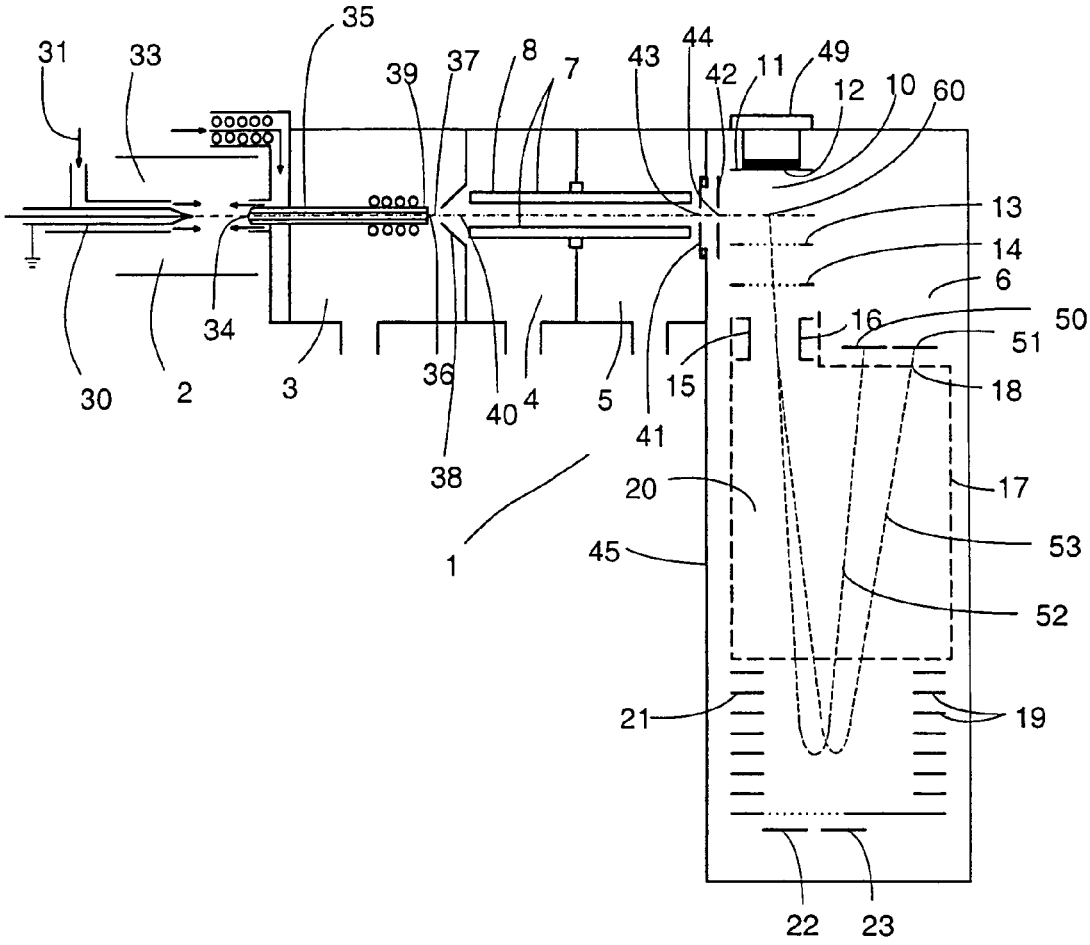
FIG. 2 is a diagram of one embodiment of the invention, comprising a hybrid orthogonal pulsing ToF mass analyzer configured with an Electrospray ion source, an ion guide and transfer optics, and a dual detector system, in which an ion population is directed to impact one detector of a dual detector configuration, or the other detector, exclusively.

Alternatively, as illustrated in FIG. 2, an ion beam segment centered at 60 may be directed to impact detector 50 entirely, or may be directed to impact detector 51 entirely. In FIG. 2, the ion beam segment centered at 60 traverses the various regions of the ToF mass spectrometer as indicated by the trajectory line 52 in order to impact detector 50, or as indicated by the trajectory line 53 in order to impact detector 51. In the illustration of FIG. 2, the ion beam segment centered at 60 is directed to impact detector 50 or detector 51 by electrostatic deflection in the field between deflector electrodes 15 and 16. In conjunction with such steering, detectors 50 and 51 can be tilted as is described in U.S. Pat. No. 5,654,544 to achieve maximum resolving power.

It will be understood by those skilled in the art that such deflection of charged particles may also be accomplished by magnetic deflection fields, or by a combination of electrostatic and magnetic deflection fields. Any such deflection field-generating devices and methods are included within the scope of the present invention. Further, in case the particles to be detected are photons, optical deflection devices and methods may be used, such as mirrors, lenses, prisms, and the like, and such optical devices and methods are also included within the scope of the present invention.

In FIGS. 1 and 2, the dual detector arrangement consisting of detectors 22 and 23 may be used instead of detectors 50 and 51 by de-activating the reflectron mirror, and allowing the ion beam segment to pass through the reflectron mirror 21 after the first traverse of the drift region 20. The dual detector arrangement of detectors 22 and 23 may be utilized in the same manner as described above for the dual detector arrangement 50 and 51.

Figure 3:
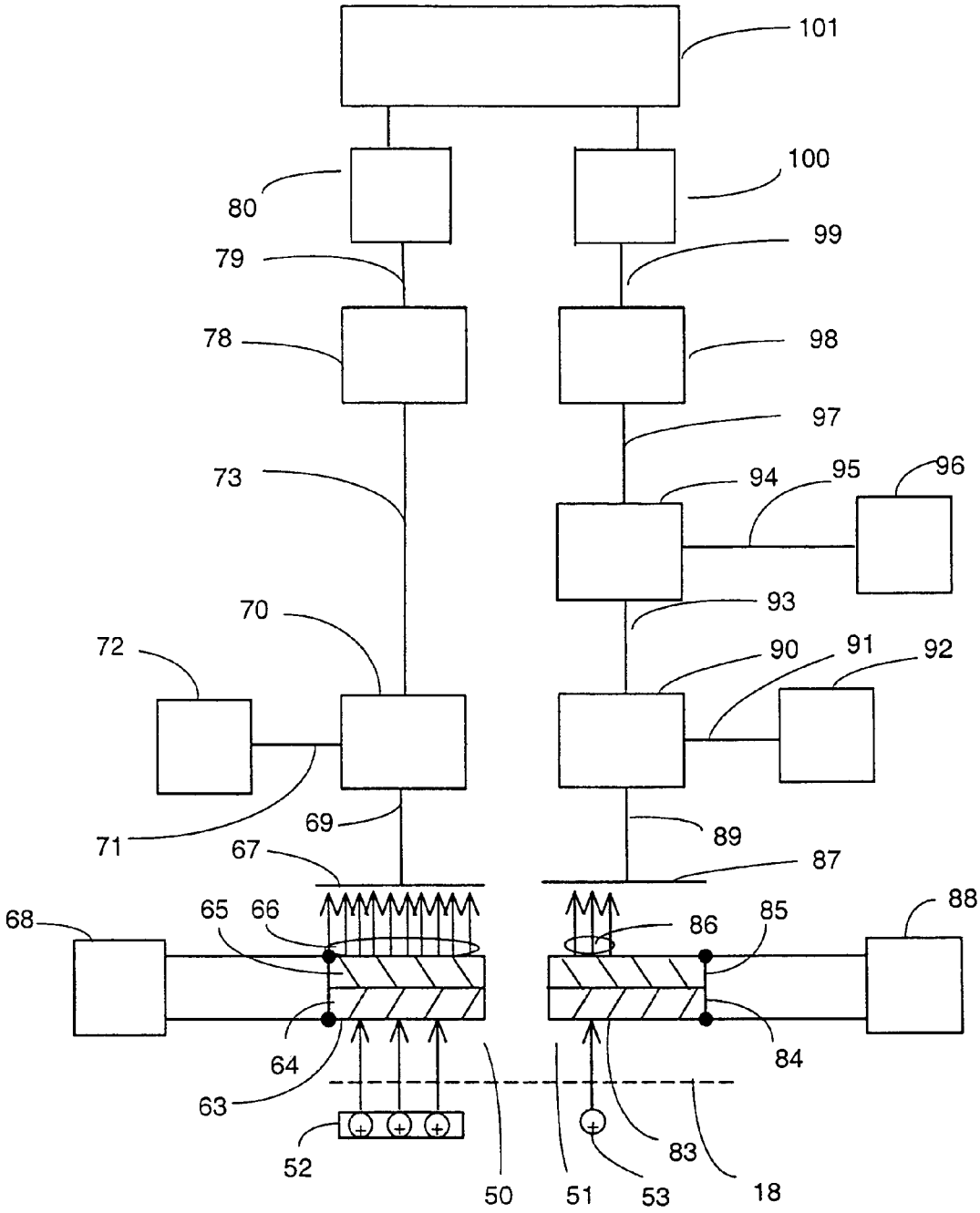
FIG. 3 is a diagram of one embodiment of the invention that illustrates a dual detector arrangement consisting of two separate and independent detectors, each comprising a dual microchannel plate multiplier assembly and a collector anode, where one detector is coupled to a fast ADC signal processing and recording electronics, and the other detector is coupled to a time-to-digital converter signal processing and recording electronics.

A more detailed illustration of one preferred embodiment of the present invention is shown in FIG. 3. Detector 50 consists of a dual channel electron multiplier plate assembly 63, which is comprised of two channel electron multiplier plates 64 and 65 in series, so that, in response to the impact of ions 52, the first plate 64 produces an amplified output current which is further amplified by the second plate 65. An anode 67 collects the output current 66 of the second microchannel plate electron multiplier 65. The gain of the multiplier assembly is controlled by the voltage differential applied between the front surface of plate 64 and the back surface of plate 65. This voltage differential is provided by power supply 68. The output current 66 collected by anode 67 flows to the input 69 of amplifier 70. The gain of amplifier 70 is controlled by a reference voltage from gain control supply 72 provided at the gain control input 71 of amplifier 70. The amplified signal at the output of the amplifier 70 is provided to the input 73 of a fast analog-to-digital converter 78, which converts the analog signal to a sequence of digital values corresponding to the amplitude of the signal as a function of time. The array of digital values therefore represents the ion flux arriving at the detector 50 as a function of time, which is easily interpreted as the m/z spectrum of ions in the ion population. A number of such spectra may be integrated in integrating memory 80, in order to improve the signal-to-noise and intensity dynamic range of the spectrum, before being transferred to the memory of computer 101 for digital processing.

Similarly, detector 51 consists of a dual channel electron multiplier plate assembly 83, which is comprised of two channel electron multiplier plates 84 and 85 in series, so that, in response to the impact of ions 53, the first plate 84 produces an amplified output current which is further amplified by the second plate 85. An anode 87 collects the output current 86 of the second microchannel plate electron multiplier 85. The gain of the multiplier assembly is controlled by the voltage differential applied between the front surface of plate 84 and the back surface of plate 85. This voltage differential is provided by power supply 88. The output current 86 collected by anode 87 flows to the input 89 of amplifier 90. The gain of amplifier 90 is controlled by a reference voltage from gain control supply 92 provided at the gain control input 91 of amplifier 90. The amplified signal at the output of the amplifier 90 is provided to the input 93 of a discriminator 94, which compares the amplitude of the signal at input 93 with the amplitude of a reference level provided at threshold reference input 95, which is adjusted by threshold reference adjustment supply 96. If the amplitude of the signal at input 93 is greater than the amplitude of the reference level at threshold reference input 95, then the discriminator 94 produces an output pulse, which is provided to the input 97 of a time-to-digital converter (TDC) 98. If the amplitude of the signal at input 93 is less than the amplitude of the reference level at threshold reference input 95, then the discriminator 94 produces no output pulse, which is also sensed at the input 97 of the TDC 98. The TDC continually senses whether a pulse has occurred at each increment or cycle of a clock or timer. If the discriminator produces a pulse at any clock cycle, the time of the pulse relative to some start time is registered, and the corresponding time bin in a histogram memory array is incremented by one. The start time of the clock typically corresponds to the time of pulse acceleration of the ions into the ToF drift region, so the time recorded by the TDC corresponds to the flight time of ions in the ToF mass spectrometer. A number of such spectra are typically integrated in histogram integrating memory 100 to produce a histogram corresponding to an average ToF spectrum, before the spectrum is transferred to the memory of computer 101.

The spectral information from both detection systems may be integrated in the computer 101 in real time during data acquisition, or after data recording, to produce a composite integrated spectrum. Because each detector 50 and 51 may be operated completely independently and simultaneously within the time of a spectrum acquisition, the operation of each detection system may be optimized separately with respect to signal-to-noise and dynamic range. For example, the TDC detector 51 may be operated with high gain as controlled by multiplier differential power supply 88, and the output signal from detector 51 combined with a discriminator 94 to achieve better signal-to-noise for the detection of single ion 'hits' than with a fast ADC for some m/z values. On the other hand, the fast ADC detector 50 may be operated at a lower gain, as set by the multiplier differential supply 68, than would typically be employed because it would no longer be required to efficiently detect single ion hits. Operating the fast ADC detector 50 with a lower gain may allow the detector 50 to operate with a signal linear dynamic range that extends to greater maximum signal levels, while maintaining a linear response, than if it were operated with the higher gain necessary to detect single ion hits with good efficiency. Hence, the spectrum resulting from the integration of the TDC spectrum of single ion hits from detector 51 and the ADC spectrum of simultaneous multiple-ion hits from detector 50, may exhibit a greater dynamic range and signal-to-noise than would be possible with the prior art of only one of these detection systems.

While it will often prove useful to ultimately produce a so-called 'composite' spectrum from the separate spectra that result from the two or more detectors of the present invention, as alluded to above, as well as in the descriptions of many of the preferred embodiments presented herein, it should be understood that it is also within the scope of the present invention that the formation of such a composite spectrum is unnecessary for any embodiment of the present invention. That is, the separate spectra produced by multiple detectors of the present invention may be recorded, processed, and/or stored separately, within the scope of the present invention, and, in fact, this approach will often prove to be more preferred than the creation of a composite spectrum. For example, with reference to FIG. 3, if detector 51 is employed to measure low intensity m/z peaks with relatively high gain, while detector 50 is employed to measure high intensity m/z peaks with relatively low gain, the spectra originating with detector 51 may be processed to extract information of interest regarding the relatively low intensity signals, while the spectra originating with detector 50 may be processed to extract information of interest regarding the relatively high intensity signals. The information of interest may therefore be obtained from the multiple detector system without first forming, or, indeed, ever forming, a so-called composite spectra from the separate spectra. The separate spectra may, in any case, be maintained and stored separately.

Another advantage of this embodiment of the present invention, is that, for those ion m/z values with intensities low enough to allow valid single-ion counting with a TDC, ion arrival times may be measured with greater precision and accuracy with a TDC than with typical fast ADCs, resulting in improved m/z ToF resolving power and measurement accuracy for those low-intensity ions in the resulting integrated spectrum. Furthermore, the greater time precision of the TDC approach may provide better arrival time information for the simultaneous arrival of multiple ions at other m/z values than the fast ADC. In this case, amplitude information may be provided by the fast ADC detection system, while the arrival time information for all m/z values as measured by the TDC detection system is used to enhance the precision and accuracy of the measured m/z values.

Therefore, this aspect of the present invention allows the multiple-ion amplitude information from the ADC to be combined with the more precise arrival time information and better signal-to-noise of the TDC, the result being that m/z ToF spectra may be produced with greater dynamic range, time resolution, and signal-to-noise than is possible with the prior art detection systems. Furthermore, although FIG. 4 illustrates only two detectors configured this way, it should be understood that any number of detectors may be configured similarly within the scope of this embodiment of the present invention, including multiple detectors coupled to separate ADC electronics, as well as other detectors coupled to TDC electronics.

Figure 4:
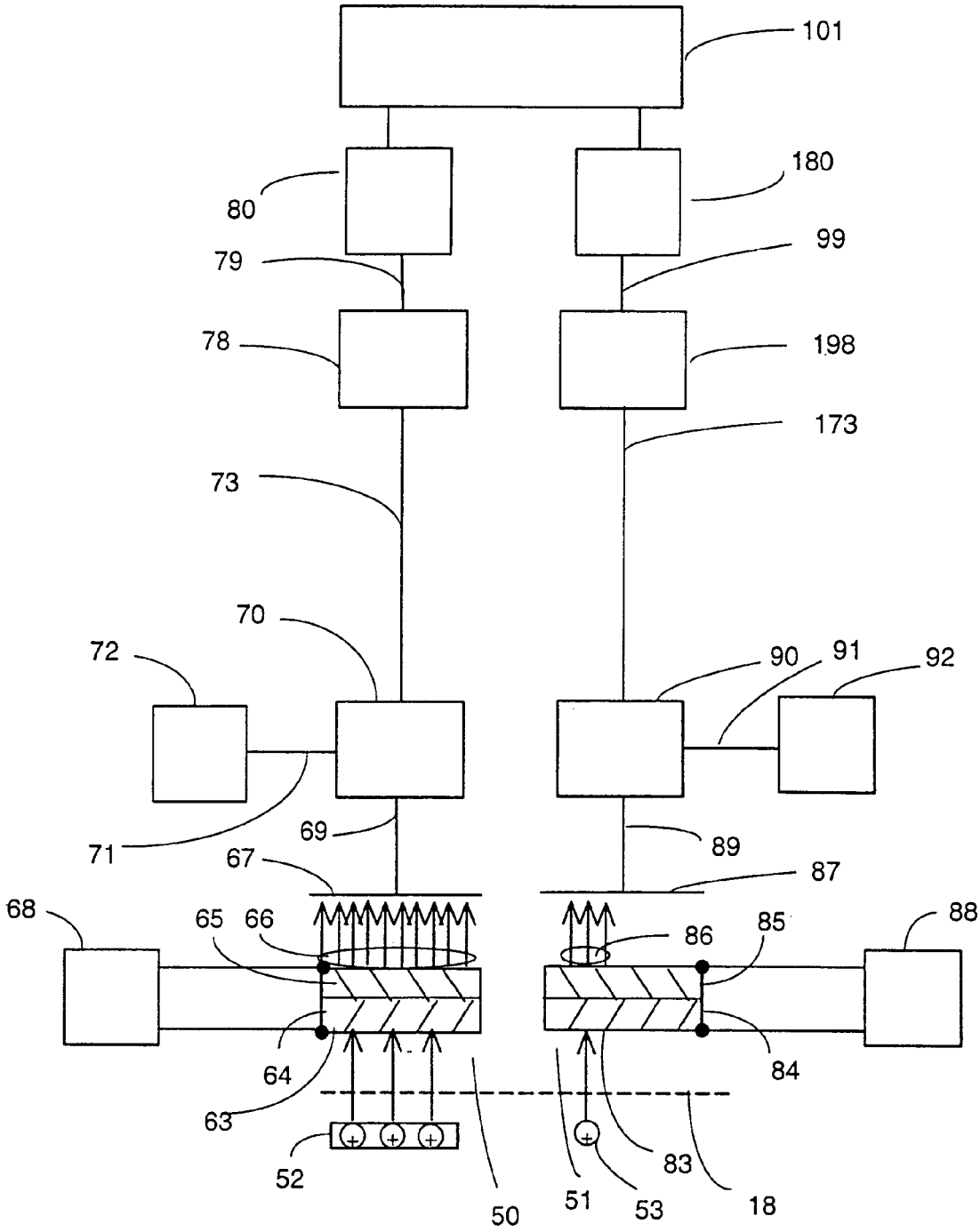
FIG. 4 is a diagram of one embodiment of the invention that illustrates a dual detector arrangement in which both detectors are coupled to separate fast ADC signal processing and recording electronics.

An illustration of another preferred embodiment of the present invention is shown in FIG. 4. In FIG. 4, detector 50 consists of a dual channel electron multiplier plate assembly 63, which is comprised of two channel electron multiplier plates 64 and 65 in series, so that, in response to the impact of ions 52, the first plate 64 produces an amplified output current which is further amplified by the second plate 65. An anode 67 collects the output current 66 of the second microchannel plate electron multiplier 65. The gain of the multiplier assembly is controlled by the voltage differential applied between the front surface of plate 64 and the back surface of plate 65. This voltage differential is provided by power supply 68. The output current 66 collected by anode 67 flows to the input 69 of amplifier 70. The gain of amplifier 70 is controlled by a reference voltage from gain control supply 72 provided at the gain control input 71 of amplifier 70. The amplified signal at the output of the amplifier 70 is provided to the input 73 of a fast analog-to-digital converter 78, which converts the analog signal to a sequence of digital values corresponding to the amplitude of the signal as a function of time. The array of digital values therefore represents the ion flux arriving at the detector 50 as a function of time, which is easily interpreted as the m/z spectrum of ions in the ion population. A number of such spectra may be integrated in integrating memory 80, in order to improve the signal-to-noise and intensity dynamic range of the spectrum, before being transferred to the memory of computer 101 for digital processing.

Similarly, detector 51 in FIG. 4 consists of a dual channel electron multiplier plate assembly 83, which is comprised of two channel electron multiplier plates 84 and 85 in series, so that, in response to the impact of ions 53, the first plate 84 produces an amplified output current which is further amplified by the second plate 85. An anode 87 collects the output current 86 of the second microchannel plate electron multiplier 85. The gain of the multiplier assembly is controlled by the voltage differential applied between the front surface of plate 84 and the back surface of plate 85. This voltage differential is provided by power supply 88. The output current 86 collected by anode 87 flows to the input 89 of amplifier 90. The gain of amplifier 90 is controlled by a reference voltage from gain control supply 92 provided at the gain control input 91 of amplifier 90. The amplified signal at the output of the amplifier 90 is provided to the input 173 of a fast analog-to-digital converter 178, which converts the analog signal to a sequence of digital values corresponding to the amplitude of the signal as a function of time. The array of digital values therefore represents the ion flux arriving at the detector 51 as a function of time, which is easily interpreted as the m/z spectrum of ions in the ion population. A number of such spectra may be integrated in integrating memory 180, in order to improve the signal-to-noise and intensity dynamic range of the spectrum, before being transferred to the memory of computer 101 for digital processing. The spectral information from both detection systems may be integrated in the computer 101 in real time during data acquisition, or after data recording, to produce a composite integrated spectrum.

Because each detector 50 and 51 and their associated electronics may be operated completely independently, the operation of each detection system may be optimized separately with respect to dynamic range. According to this aspect of the present invention, the gain of multiplier 63 of detector 50 may be adjusted by adjusting multiplier differential supply 68 to a low enough value to ensure that the greatest number of simultaneously arriving ions within a m/z spectrum does not produce a multiplier output signal 66 that exceeds the maximum linear dynamic range of the multiplier 63. The gain of the signal amplifier 70, that couples the output 66 of multiplier 63 collected on anode 67 to fast ADC 78, may also be adjusted by gain adjustment control 72 to ensure that the maximum signal in the spectrum does not exceed the maximum digitization range of the ADC 78. With these operating conditions, signals within each individual spectrum may be recorded with amplitudes that vary within a maximum range of 0 to 255 digitizer counts with an 8-bit ADC. However, with these operating conditions, single ion hits may not produce signal amplitudes 66 great enough to register at least 1 ADC count, and therefore may not be detected. Indeed, if the number of simultaneously arriving ions of any particular m/z value is less than the number that results in 1 ADC count, then ions of those m/z values will not be detected with these gain settings of the multiplier 63 and amplifier 70.

The gain of the other multiplier 83, and/or the gain of its associated amplifier 90, may be adjusted to higher levels than those of the multiplier 63 and/or amplifier 70 as described above, so that fewer simultaneously arriving ions produce the maximum ADC count of the ADC 198, than are necessary to produce the maximum ADC count of the ADC 78. With these settings of gains for multipliers 83 and 63, and amplifiers 90 and 70, then, a fewer number of simultaneously arriving ions will produce a signal amplitude that is large enough to correspond to more than 1 count in the ADC, and therefore be detected, with detector 50 than are required with detector 51. Of course, larger signal amplitudes in the spectrum will exceed the linear dynamic range of detector 51 and/or the maximum count of the ADC, but these largest signal amplitudes would be accurately measured by detector 50 owing to the reduced gain of multiplier 63 and/or amplifier 70 relative to that of multiplier 83 and/or amplifier 90. By properly scaling the amplitudes of the m/z peaks in each detector's spectrum and combining the two spectra into one composite spectrum, the resulting spectrum may exhibit a signal dynamic range that is greater than would be possible with prior art single detectors coupled to a fast ADC. Proper scaling of the peak amplitudes in each spectrum is straightforward because some peaks in the m/z spectrum will typically be within the dynamic range of both detection systems, or at least the adjustment of gains may be performed in order to ensure that the amplitudes of some m/z peaks in the spectrum fall within the dynamic range of both detectors, allowing an unambiguous cross calibration of peak amplitudes between the two spectra.

According to another aspect of the present invention, the gain of multiplier 63 of detector 50 may be adjusted by adjusting multiplier differential supply 68 to a high enough value to ensure that the greatest number of simultaneously arriving ions within a m/z spectrum does not produce a multiplier output signal 66 that exceeds the maximum linear dynamic range of the multiplier 63. The gain of the signal amplifier 70, that couples the output 66 of multiplier 63 collected on anode 67 to fast ADC 78, may also be adjusted by gain adjustment control 72 to ensure that the maximum signal in the spectrum does not exceed the maximum digitization range of the ADC 78. With these operating conditions, signals within each individual spectrum may be recorded with amplitudes that vary within a maximum range of 0 to 255 digitizer counts with an 8-bit ADC. However, with these operating conditions, single ion hits may not produce signal amplitudes 66 great enough to register at least 1 ADC count, and therefore may not be detected. Indeed, if the number of simultaneously arriving ions of any particular m/z value is less than the number that results in 1 ADC count, then ions of those m/z values will not be detected with these gain settings of the multiplier 63 and amplifier 70.

The gain of the other multiplier 83, and/or the gain of its associated amplifier 90, may be adjusted to higher levels than those of the multiplier 63 and/or amplifier 70 as described above, so that fewer simultaneously arriving ions produce the maximum ADC count of the ADC 198, than are necessary to produce the maximum ADC count of the ADC 78. With these settings of gains for multipliers 83 and 63, and amplifiers 90 and 70, then, a fewer number of simultaneously arriving ions will produce a signal amplitude that is large enough to correspond to more than 1 count in the ADC, and therefore be detected, with detector 50 than are required with detector 51. Of course, larger signal amplitudes in the spectrum will exceed the linear dynamic range of detector 51 and/or the maximum count of the ADC, but these largest signal amplitudes would be properly measured by detector 50 owing to the reduced gain of multiplier 63 and/or amplifier 70 relative to that of multiplier 83 and/or amplifier 90. By properly scaling the amplitudes of the m/z peaks in each detector's spectrum and combining the two spectra into one composite spectrum, the resulting spectrum may exhibit a signal dynamic range that is greater than would be possible with any prior art single detector coupled to a fast ADC. Proper scaling of the peak amplitudes in each spectrum is straightforward because some peaks in the m/z spectrum will typically be within the dynamic range of both detection systems, or at least the adjustment of gains may be performed in order to ensure that the amplitudes of some m/z peaks in the spectrum fall within the dynamic range of both detectors, allowing an unambiguous cross calibration of peak amplitudes between the two spectra.

In another aspect of the present invention, as depicted in FIG. 4, the gain of multiplier 83, as set by multiplier differential voltage according multiplier differential supply 88, and/or the gain of the amplifier 90, as set by amplifier gain control 92, may be adjusted to values that are high enough to ensure that single ion hits 53 produce a signal amplitude at the input 173 of the ADC 198 that is great enough to correspond to at least several ADC counts. Single ion hits 53 may then be detected and measured with good efficiency with the detector 51. However, a greater number of simultaneously arriving ions at other m/z values may produce an output 86 from multiplier 83 with this multiplier gain, which may exceed either the linear dynamic range of the multiplier 83, and/or the maximum count of the ADC 198. In this aspect of the present invention, multiplier 63 and/or its associated amplifier 70, may be operated at gain setting less than those of multiplier 83 and/or amplifier 90, such that the signal from a greater number of simultaneously arriving ions may be accommodated within the linear dynamic range of the multiplier 63, and within the count range of the ADC 78. The spectra from detector 50 may be integrated in integrating memory 80 while the spectra from detector 51 may be integrated in integrating memory 180. By properly scaling the amplitudes of the m/z peaks in each detector's spectrum and combining the two spectra into one composite spectrum, for example, in computer memory 101, the resulting spectrum may exhibit a signal dynamic range that is greater than would be possible with any prior art single detector coupled to a fast ADC. Proper scaling of the peak amplitudes in each spectrum is straightforward because some peaks in the m/z spectrum will typically be within the dynamic range of both detection systems, or at least the adjustment of gains may be performed in order to ensure that the amplitudes of some m/z peaks in the spectrum fall within the dynamic range of both detectors, allowing an unambiguous cross calibration of peak amplitudes between the two spectra. Furthermore, although FIG. 4 illustrates only two detectors configured this way, it should be understood that any number of detectors may be configured similarly within the scope of this embodiment of the present invention.

Figure 5:
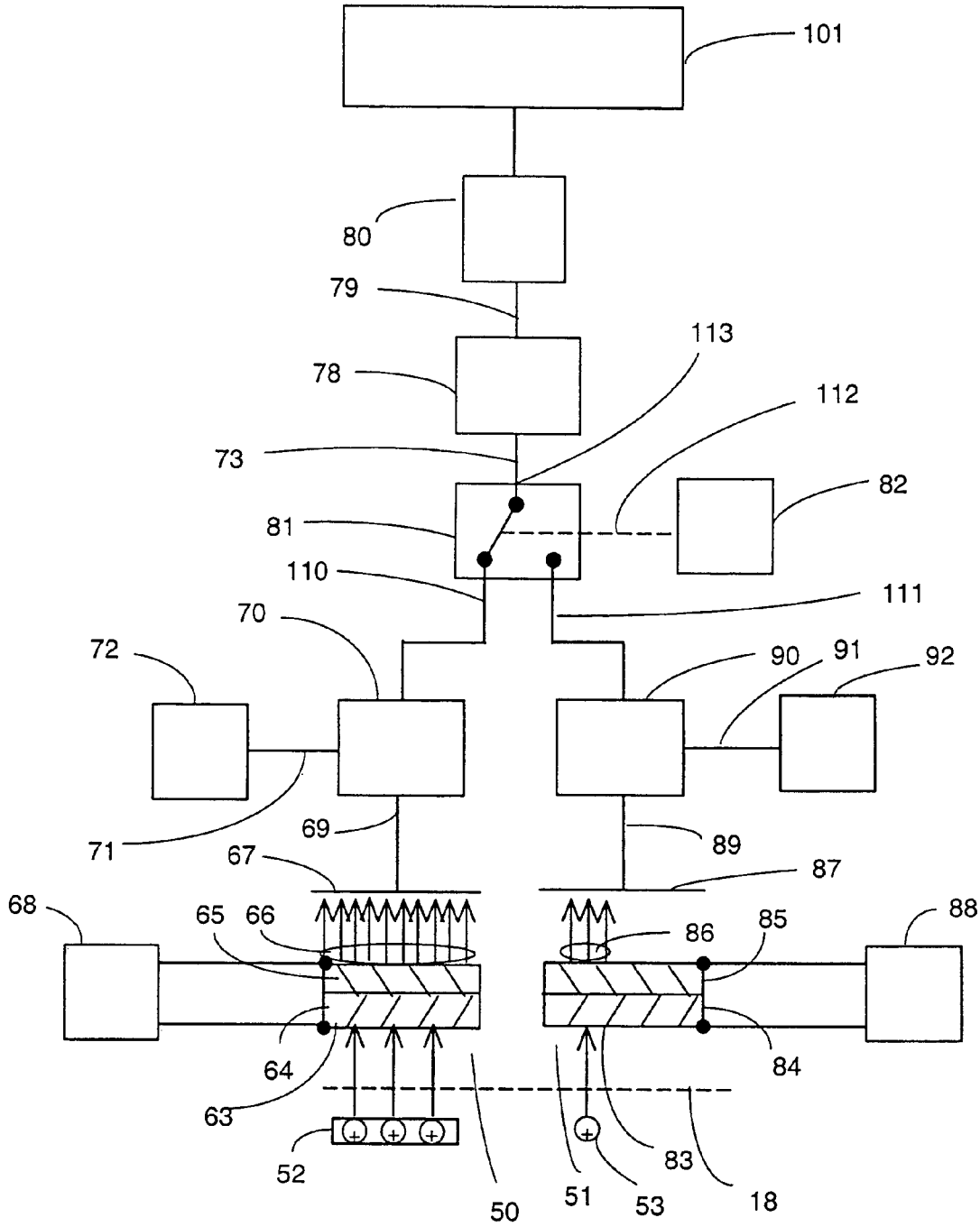
FIG. 5 is a diagram of one embodiment of the invention that illustrates a dual detector arrangement in which each detector is coupled to separate fast signal amplifier electronics, the outputs of which are routed to the inputs of a fast analog switch. The switch selects the amplified analog signal from one detector or the other to be digitized by a single ADC electronics. A memory array stores and integrates multiple spectra from one detector or the other before transferring the integrated spectrum to computer memory.

Another preferred embodiment of the present invention is depicted in FIG. 5. In FIG. 5, detector 50 consists of a dual channel electron multiplier plate assembly 63, which is comprised of two channel electron multiplier plates 64 and 65 in series, so that, in response to the impact of ions 52, the first plate 64 produces an amplified output current which is further amplified by the second plate 65. An anode 67 collects the output current 66 of the second microchannel plate electron multiplier 65. The gain of the multiplier assembly is controlled by the voltage differential applied between the front surface of plate 64 and the back surface of plate 65. This voltage differential is provided by power supply 68. The output current 66 collected by anode 67 flows to the input 69 of amplifier 70. The gain of amplifier 70 is controlled by a reference voltage from gain control supply 72 provided at the gain control input 71 of amplifier 70. The amplified signal at the output of the amplifier 70 is provided to the input 110 of a fast analog switch 81.

Similarly, detector 51 in FIG. 5 consists of a dual channel electron multiplier plate assembly 83, which is comprised of two channel electron multiplier plates 84 and 85 in series, so that, in response to the impact of ions 53, the first plate 84 produces an amplified output current which is further amplified by the second plate 85. An anode 87 collects the output current 86 of the second microchannel plate electron multiplier 85. The gain of the multiplier assembly is controlled by the voltage differential applied between the front surface of plate 84 and the back surface of plate 85. This voltage differential is provided by power supply 88. The output current 86 collected by anode 87 flows to the input 89 of amplifier 90. The gain of amplifier 90 is controlled by a reference voltage from gain control supply 92 provided at the gain control input 91 of amplifier 90. The amplified signal at the output of the amplifier 90 is provided to a second input 111 of the fast analog switch 81.

The control source 82 provides a control signal to the switch control input 112 of switch 81, said control signal which selects input 110 or input 111 to connect to the output 113 of fast switch 81. The output 113 is connected to the input 73 of a fast ADC 78. The fast ADC converts the analog signal to a sequence of digital values corresponding to the amplitude of the signal as a function of time. The array of digital values therefore represents the time dependence of the ion flux arriving at the detector 50 or detector 51, depending on the state of fast switch 81 according to control source 82. A number of spectra from either detector 50 or detector 51 may be integrated in integrating memory 80, in order to improve the signal-to-noise and signal dynamic range of the spectrum, before being transferred to the memory of computer 101 for digital processing. The control source 82 in conjunction with fast switch 81 therefore allows a single fast ADC to be employed to integrate spectra from either detector 50 or detector 51, alternately. The spectral information from both detection systems may be integrated in the computer 101 in real time during data acquisition, or after data recording, to produce a composite integrated spectrum. Furthermore, although FIG. 5 illustrates only two detectors configured this way, it should be understood that any number of detectors may be configured similarly within the scope of this embodiment of the present invention.

Figure 6:
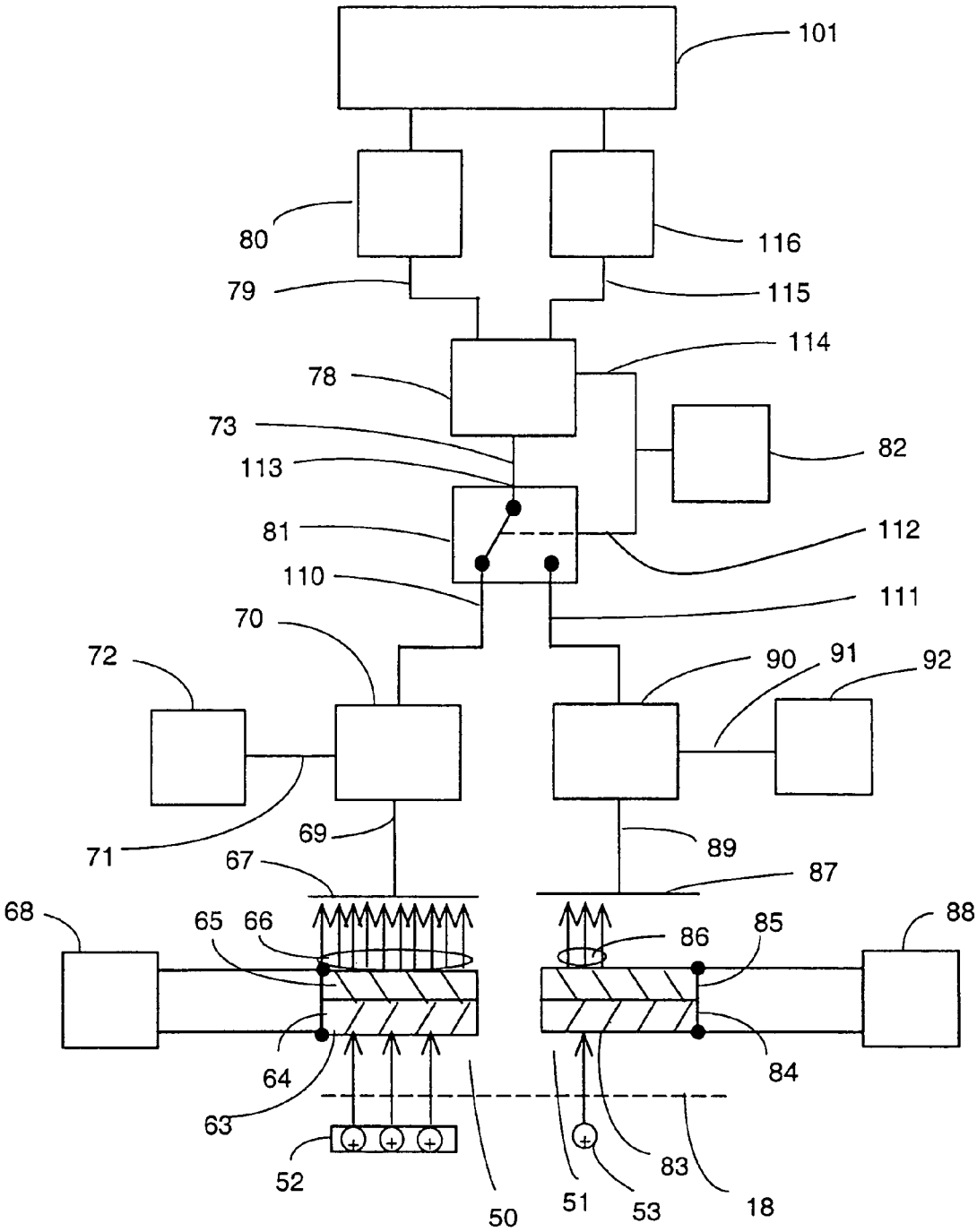
FIG. 6 is a diagram of one embodiment of the invention that illustrates a dual detector arrangement in which each detector is coupled to separate fast signal amplifier electronics, the outputs of which are routed to the inputs of a fast analog switch. The switch selects the amplified analog signal from one detector or the other to be digitized by a single ADC electronics. A memory array stores and integrates multiple spectra from one detector while another memory array stores and integrates multiple spectra from the other detector.

An alternative preferred embodiment of the present invention for the accumulation of spectra from either detector 50 or detector 51 is illustrated in FIG. 6. The configuration illustrated in FIG. 6 incorporates two separate memory arrays, 80 and 116, for the integration of spectra, whereby memory array 80 accumulates spectra corresponding to the signal at detector 50, which, as described above, is amplified by amplifier 70, selected by switch 81, and digitized by fast ADC 78, while memory array 116 similarly accumulates spectra corresponding to the signal at detector 51, which, as described above, is amplified by amplifier 90, selected by switch 81, and digitized by fast ADC 78. The same control signal from control source 82, that selects which detector's signal is digitized by fast ADC 78, is also applied to the integrating memory selection control input 114 of fast ADC 78. Therefore, when the signal from detector 50 is selected for digitization by fast ADC 78, the resulting digitized spectrum is integrated in accumulating memory 80, and when the signal from detector 51 is selected for digitization by fast ADC 78, the resulting digitized spectrum is integrated in accumulating memory 116. With this arrangement of separate integrating memory arrays, each of which is dedicated to a separate detector in a multiple detector configuration of the present invention, any number of spectra may be integrated for each detector, and in any sequence, before the integrated spectra in each histogram memory array is transferred to computer memory for further processing and possible integration into a composite spectrum. For example, one spectrum may be measured and integrated in integrating memory associated with one detector, and then the next spectrum may be measured and integrated in integrating memory associated with the other detector, and so on, until the desired number of spectra are accumulated in both integrating memories. Alternatively, a number of spectra may be measured consecutively from one detector, and then a possibly different number of spectra may be integrated from the other detector, and so on with any desired sequence of integrations. Furthermore, although FIG. 6 illustrates only two detectors configured this way, it should be understood that any number of detectors may be configured similarly within the scope of this embodiment of the present invention.

Figure 7:
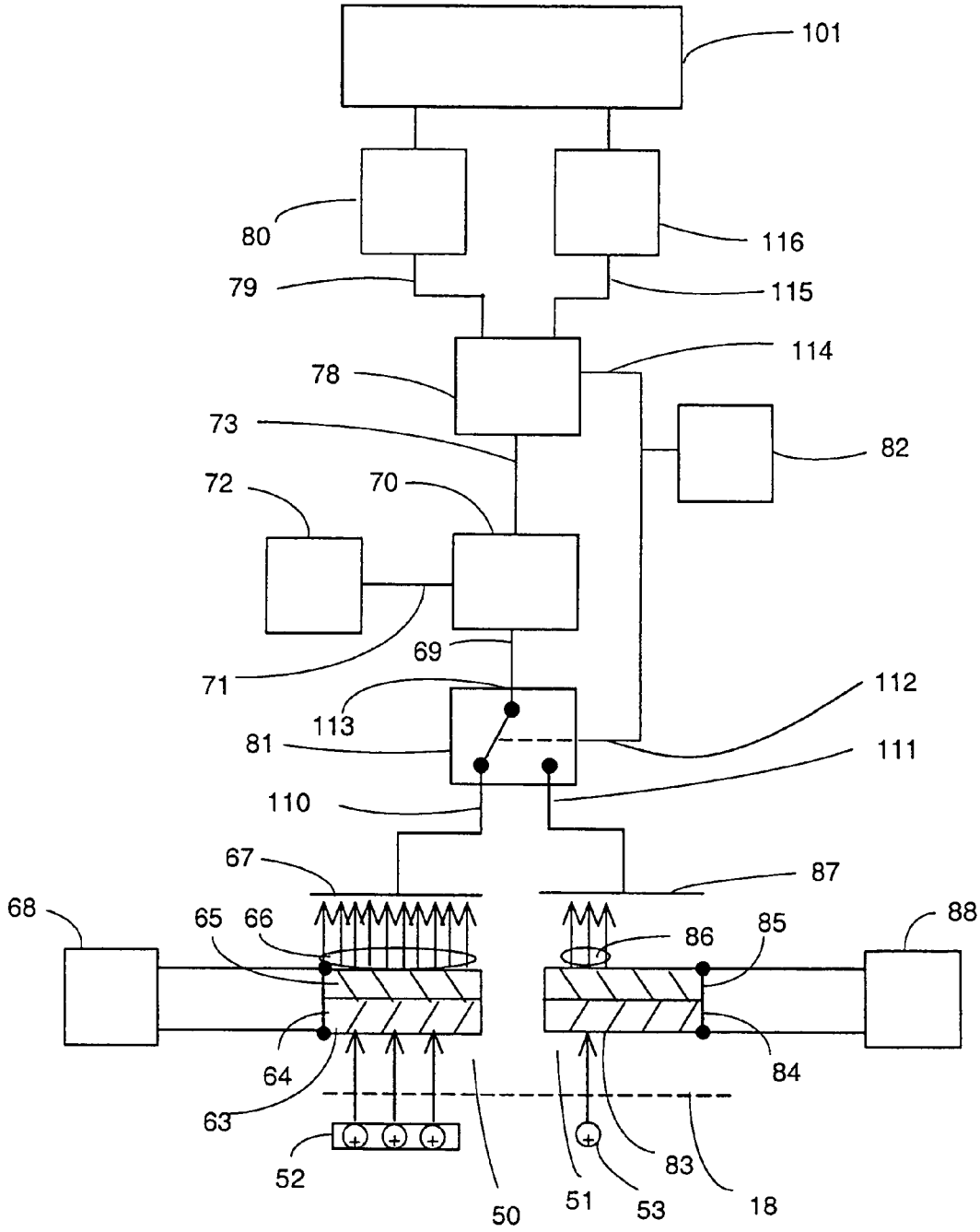
FIG. 7 is a diagram of one embodiment of the invention that illustrates a dual detector arrangement in which each detector is coupled to separate inputs of a fast analog switch. The switch selects the signal from one detector or the other to be routed to a single amplifier and/or other signal processing electronics before the amplified signal is digitized by a single fast ADC electronics.

A further alternative arrangement for the implementation of a dual detector configuration is illustrated in FIG. 7. In the configuration of FIG. 7, fast analog switch 81 is implemented to select the signal from one detector or the other before the signal is amplified. As shown in FIG. 7, the signal from detector 50, collected on anode 67, is applied to input 110 of fast analog switch 81, while the signal from detector 51, collected on anode 87, is applied to input 111 of switch 81. Control source 82 provides an input select signal to input select control input 112 of fast analog switch 81, which selects the signal from either detector 50 or the signal from detector 51 to be routed to the output 113 of switch 81. The output 113 of switch 81 is connected to the input 69 of amplifier 70, which amplifies the signal with a gain that is controlled by gain control 72 via a control signal that gain control 72 applies to the gain control input 71 of amplifier 70. The amplifier output is then applied to the input 73 of fast ADC 78, which converts the analog signal to digital values that comprise the m/z spectrum. The same control signal from control source 82, that selects which detector's signal is routed to the amplifier 70, is also applied to the integrating memory selection control input 114 of fast ADC 78. Therefore, when the signal from detector 50 is selected for amplification by amplifier 70 and subsequent digitization by fast ADC 78, the resulting digitized spectrum is integrated in accumulating memory 80 before being transferred to computer memory, and when the signal from detector 51 is selected for amplification by amplifier 70 and subsequent digitization by fast ADC 78, the resulting digitized spectrum is integrated in accumulating memory 116 before being transferred to computer memory.

Figure 8:
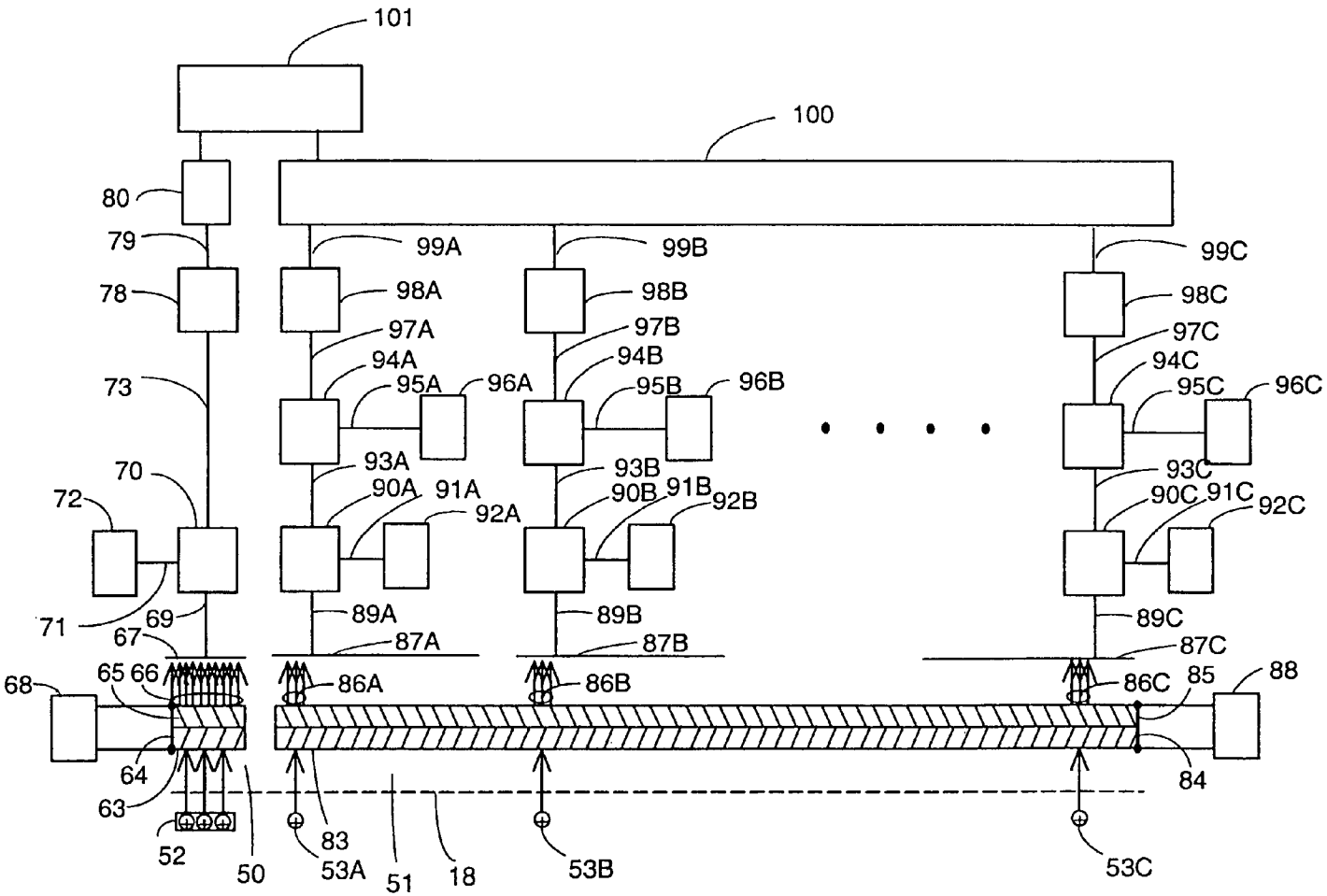
FIG. 8 is a diagram of one embodiment of the invention that illustrates a dual detector arrangement in which one detector containing a single collector anode is coupled to a fast ADC electronics, while the other detector contains multiple collector anodes, each of which is coupled to a separate TDC electronics. All of the TDC electronics share the same histogram memory.

Another preferred embodiment of the present invention is illustrated in FIG. 8, and consists of two separate and independent detectors. One detector 50 consists of a dual channel electron multiplier plate assembly 63, which is comprised of two channel electron multiplier plates 64 and 65 in series, so that, in response to the impact of ions 52, the first plate 64 produces an amplified output current which is further amplified by the second plate 65. An anode 67 collects the output current 66 of the second microchannel plate electron multiplier 65. The gain of the multiplier assembly is controlled by the voltage differential applied between the front surface of plate 64 and the back surface of plate 65. This voltage differential is provided by power supply 68. The output current 66 collected by anode 67 flows to the input 69 of amplifier 70. The gain of amplifier 70 is controlled by a reference voltage from gain control supply 72 provided at the gain control input 71 of amplifier 70. The amplified signal at the output of the amplifier 70 is provided to the input 73 of a fast analog-to-digital converter 78, which converts the analog signal to a sequence of digital values corresponding to the amplitude of the signal as a function of time. The array of digital values therefore represents the ion flux arriving at the detector 50 as a function of time, which is easily interpreted as the m/z spectrum of ions in the ion population. A number of such spectra may be integrated in integrating memory 80, in order to improve the signal-to-noise and intensity dynamic range of the spectrum, before being transferred to the memory of computer 101 for digital processing.

Similarly, a second detector 51 consists of a dual channel electron multiplier plate assembly 83, which is comprised of two channel electron multiplier plates 84 and 85 in series, so that, in response to the impact of ions 53A, 53B, 53C, etc., the first plate 84 produces an amplified output current which is further amplified by the second plate 85. This second detector 51 is configured with a multiplicity of collector anodes, anode 87A, anode 87B, anode 87C, etc., which collect the corresponding output currents 86A, 86B, 86C, etc., respectively, of the second microchannel plate electron multiplier 85, resulting from the impact of ions 53A, 53B, 53C, etc., respectively. The gain of the multiplier assembly is controlled by the voltage differential applied between the front surface of plate 84 and the back surface of plate 85. This voltage differential is provided by power supply 88. The output currents 86A, 86B, 86C, etc., collected respectively by anodes 87A, 87B, 87C, etc., flows to the inputs 89A, 89B, 89C, etc., of amplifiers 90A, 90B, 90C, etc., respectively. The gains of amplifiers 90A, 90B, 90C, etc. are controlled by reference voltages from gain control supplies 92A, 92B, 92C, etc., provided at the gain control inputs 91A, 91B, 91C, etc., of amplifiers 90A, 90B, 90C, etc., respectively. The amplified signals at the outputs of the amplifiers 90A, 90B, 90C, etc., are provided to the inputs 93A, 93B, 93C, etc., of discriminators 94A, 94B, 94C, etc., which compare the amplitudes of the signals at inputs 93A, 93B, 93C, etc., with the amplitudes of reference levels provided at threshold reference inputs 95A, 95B, 95C, etc., which are adjusted by threshold reference adjustment supplies 95A, 95B, 95C, etc., respectively. If the amplitude of the signal at any input 93A, or 93B, or 93C, etc., is greater than the amplitude of the reference level at threshold reference input 95A, or 95B, or 95C, etc., respectively, then the discriminator 94A, or 94B, or 94C, etc., produces an output pulse, which is provided to the input 97A, or 97B, or 97C, etc., of a TDC 98A, or 98B, or 98C, etc., respectively. If the amplitude of the signal at input 93A, or 93B, or 93C, etc., is less than the amplitude of the reference level at threshold reference input 95A, or 95B, or 95C, etc., respectively, then the discriminator 94A, or 94B, or 94C, etc., produces no output pulse, which is also sensed at the input 97*a*, or 97B, or 97C, etc., of the TDC 98A, or 98B, or 98C, etc., respectively. The TDC 98A, 98B, 98C, etc. continually sense whether a pulse has occurred at each increment or cycle of a clock or timer. If any discriminator produces a pulse at any clock cycle, the time of the pulse relative to some start time is registered, and the corresponding time bin in a histogram memory array, shared among all TDC's, is incremented by one. The start time of the clock typically corresponds to the time of pulse acceleration of the ions into the ToF drift region, so the time recorded by any TDC corresponds to the flight time of ions in the ToF mass spectrometer. A number of such spectra are typically integrated in histogram integrating memory 100 to produce a histogram corresponding to an average ToF spectrum, before the spectrum is transferred to the memory of computer 101.

With such a multiple-anode detector configuration, the dynamic range may be extended beyond that of a single anode detector configuration. However, because the dynamic range is nevertheless limited by the number of anodes that may be practical to implement in a particular application, this embodiment of the present invention allows the signal dynamic range capability to be extended even further than the multiple-anode TDC detector dynamic range, owing to the incorporation of an additional detector and an ADC electronics, the gains of which may be optimized to measure and record signals with amplitudes greater than that which may be accommodated by the multiple-anode TDC detector.

Another advantage of this embodiment of the present invention, is that, for those ion m/z values with intensities low enough to allow signal recording with the TDCs, ion arrival times may be measured with greater precision and accuracy than with typical fast ADCs, resulting in improved m/z ToF resolving power and measurement accuracy for those low-intensity ions in the resulting integrated spectrum. Furthermore, the greater time precision of the TDC approach may provide better arrival time information for the simultaneous arrival of multiple ions at other m/z values, which signals may extend beyond the dynamic range of the multiple-anode TDC configuration, than the fast ADC. In this case, amplitude information may be provided by the fast ADC detection system, while the arrival time information for all m/z values as measured by the TDC detection system is used to enhance the precision and accuracy of the measured m/z values.

Therefore, this aspect of the present invention allows the multiple-ion amplitude information from the ADC to be combined with the more precise arrival time information and better signal-to-noise of the TDC, the result being that m/z ToF spectra may be produced with greater dynamic range, time resolution, and signal-to-noise than is possible with the prior art detection systems.

Figure 10:
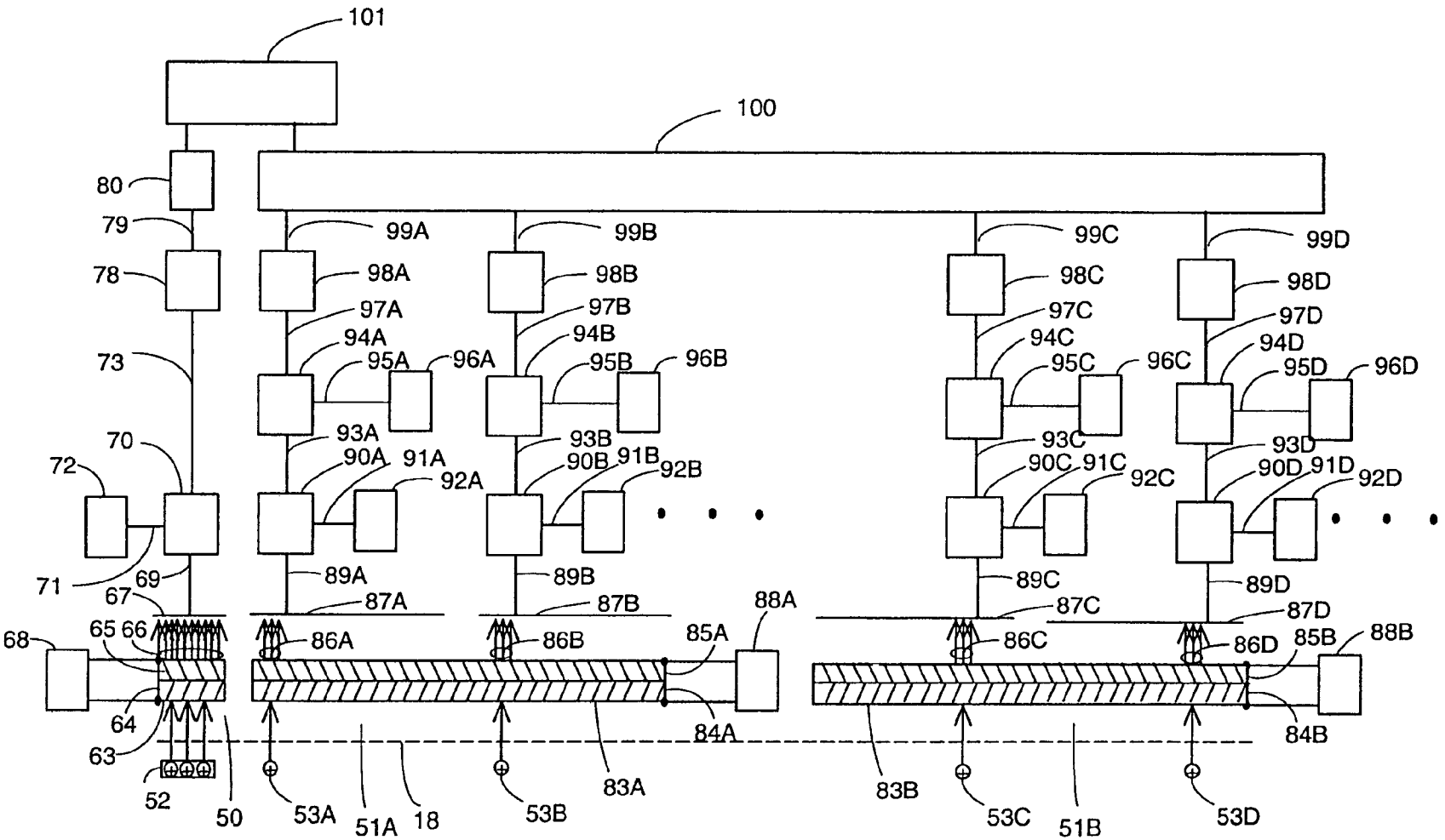
FIG. 10 is a diagram of one embodiment of the invention that illustrates a triple detector arrangement in which one detector containing a single collector anode is coupled to a fast ADC electronics; and in which a second and third detector each contains two anodes, each of which are each coupled to separate TDC electronics, but all of which share a common histogram memory array.

Although FIG. 8 illustrates one detector configured with a fast ADC acquisition system, and only one other detector configured with multiple anodes, in which each anode is coupled to a separate TDC acquisition system, in fact, any number of detectors may be included and similarly configured within the scope of this embodiment of the present invention, including multiple detectors coupled to separate ADC electronics, as well as other multiple-anode detectors coupled to multiple-anode, multiple-TDC electronics. One example of such a variation of this embodiment is illustrated in FIG. 10, which consists of three separate and independent detectors, detector 50, detector 51A, and detector 51B. Detector 50 and detector 51A are identical in configuration and operation as described above for detector 50 and detector 51, respectively, in FIG. 8. The only difference between the embodiment illustrated in FIG. 10 from the embodiment illustrated in FIG. 8 is the addition in the embodiment of FIG. 10 of detector 51B. Detector 51B, and the electronics systems associated with it, are, in fact, configured and operated identical to those of detector 51A. That is, both of these detectors are configured with multiple anodes, with each anode coupled to a separate and independent TDC acquisition electronics. However, all TDC acquisition systems of all such detectors may share the same integrating histogram memory array. Effectively, then, the performance and operation of the configuration illustrated in FIG. 10 is similar to that of the embodiment illustrated in FIG. 8, the fundamental difference between these two embodiments being that the multiple anode/TDC acquisition systems are divided among two or more detectors in the configuration of FIG. 10, while all of the anode/TDC acquisition systems were included within the structure of a single detector, detector 50, in the embodiment of FIG. 8. The embodiment illustrated in FIG. 10 therefore shares all the advantages, relative to prior art detectors, of the embodiment of FIG. 8, with the additional advantage that the embodiment of FIG. 10 may utilize smaller microchannel plate multipliers in detectors 51A and 51B to cover the same detection area as the single detector 50 in FIG. 8. The utilization of smaller, multiple detectors to cover the same area as a single detector becomes increasingly more advantageous, as the detection area increases, for at least two reasons: First, microchannel plate multipliers become increasingly more difficult and costly to manufacture as their size increases, and so the availability and cost of multiple, smaller microchannel plates that cover a certain large dimension may be better than that of a single microchannel plate that covers the same dimensional detection area. Second, it is generally impractical or impossible to manufacture large microchannel plate multipliers with the same degree of flatness as smaller microchannel plates, which is important for achieving good m/z resolving power in a ToF mass spectrometer. Therefore, a multiple detector arrangement, according to this embodiment of the present invention, may provide better time resolving power, due to superior detector surface flatness of multipliers with smaller dimensions, in a ToF mass spectrometer.

Figure 11:
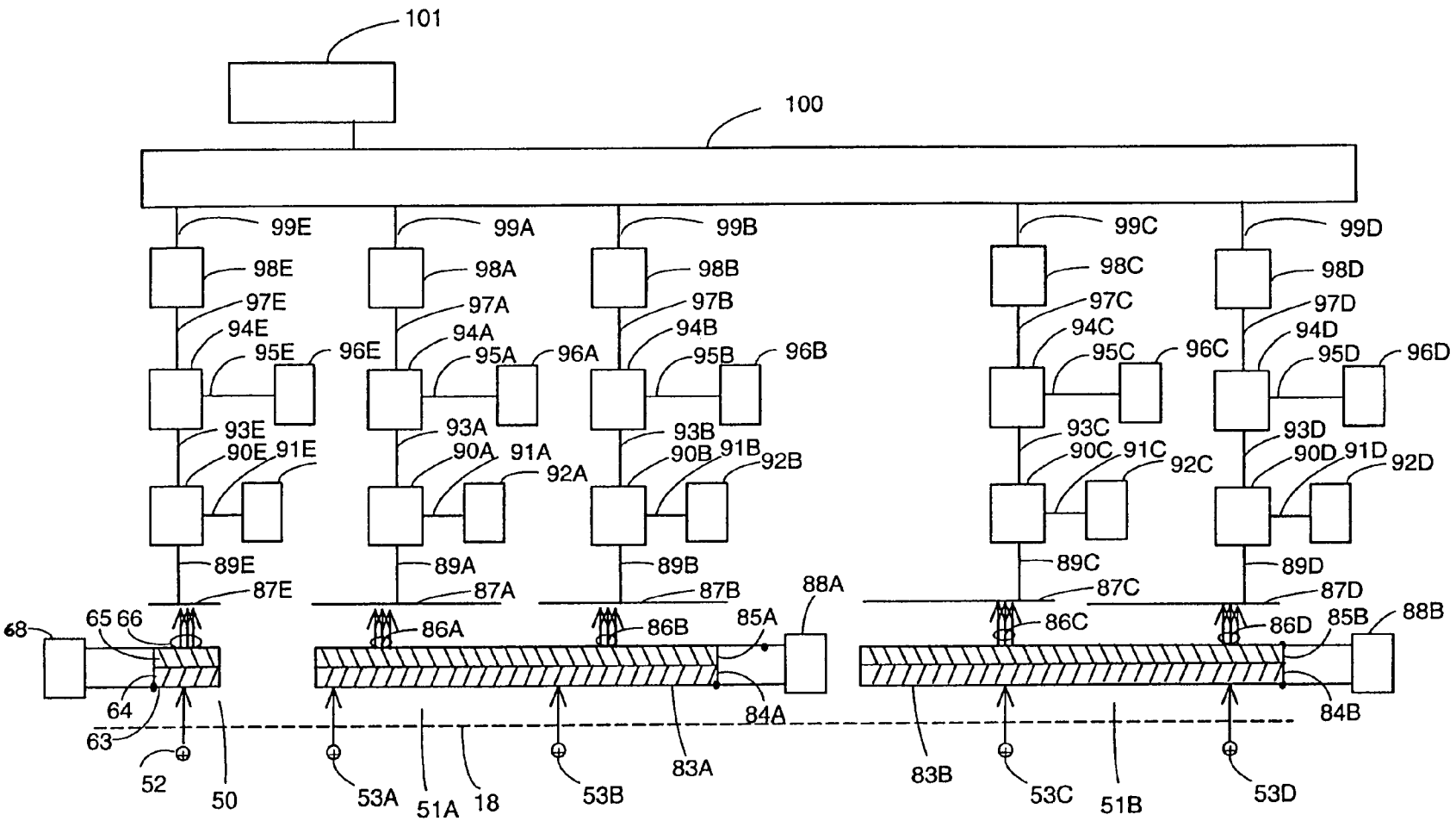
FIG. 11 is a diagram of one embodiment of the invention that illustrates a triple detector arrangement in which one detector containing a single collector anode is coupled to a fast TDC electronics; and in which a second and third detector each contains two anodes, each of which are coupled to separate TDC electronics; and in which all TDC electronics from all detectors share a common histogram memory array.

Another preferred embodiment of the present invention is illustrated in FIG. 11, which is similar to the configuration of FIG. 10, except that detector 50 is coupled to an additional TDC acquisition system rather than a fast ADC acquisition system. The embodiment of FIG. 11 then consists entirely of multiple detectors, three being illustrated in FIG. 11, each of which may be configured with multiple anodes, where each anode may be coupled to a separate TDC acquisition system. All TDC acquisition systems may histogram data in the same integrating histogram memory array 100. This configuration may be less costly and more straightforward to implement than the configurations that include both ADC acquisition systems as well as TDC acquisitions, such as those illustrated in FIGS. 3, 8, 9, and 10. This embodiment of the present invention, therefore, is advantageous, with respect to performance, cost and complexity, for applications in which ions of any m/z arriving simultaneously may always be distributed across the detectors so that the signal at any one anode always corresponds to less than about 0.1 ion on average.

Figure 9:
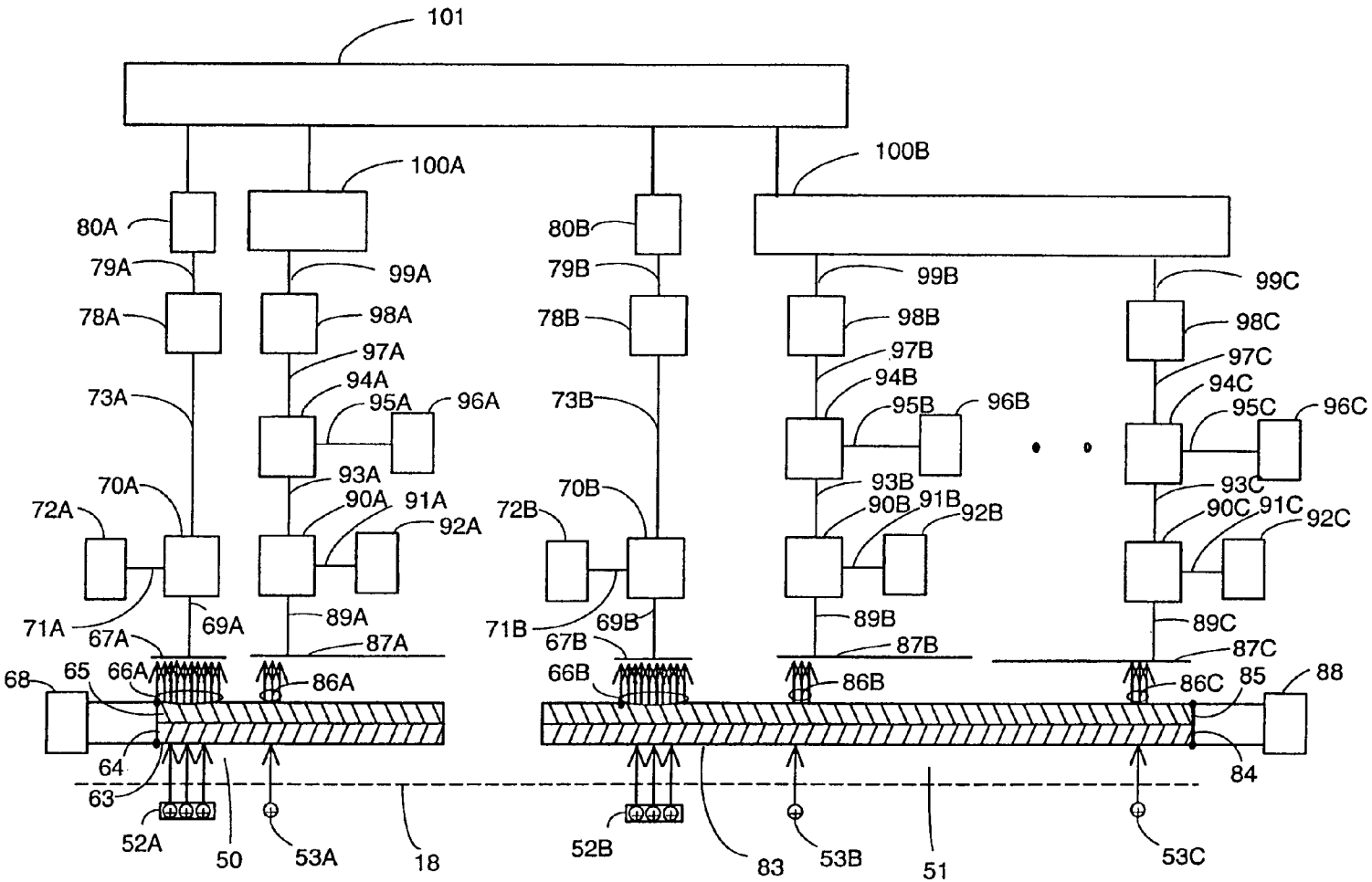
FIG. 9 is a diagram of one embodiment of the invention that illustrates a dual detector arrangement in which one detector contains two collector anodes, one of which is coupled to ADC electronics, and the other of which is coupled to TDC electronics including a separate histogram memory array; and in which the other detector contains multiple anodes, one of which is coupled to ADC electronics, and all the others of which are each coupled to separate TDC electronics, but which share a common histogram memory array.

Another preferred embodiment of the present invention is illustrated in FIG. 9. This embodiment consists of a multiple-detector configuration, a dual-detector configuration being specifically illustrated in FIG. 9, in which each detector may be configured with a multiple number of collector anodes. At least one anode of each detector is coupled to an ADC signal processing and recording electronics, while each other anode of each detector is coupled to separate and independent TDC signal processing and recording electronics.

In the embodiment illustrated in FIG. 9, one detector 50 consists of a dual channel electron multiplier plate assembly 63, which is comprised of two channel electron multiplier plates 64 and 65 in series, so that, in response to the impact of ions 52A and ions 53A, the first plate 64 produces an amplified output current which is further amplified by the second plate 65. An anode 67A collects the output current 66A of the second microchannel plate electron multiplier 65, which output current 66A corresponds to ions 52A at the input of microchannel plate assembly 63, while a second anode 87A collects the output current 86A of the second microchannel plate electron multiplier 65, which output current 86A corresponds to ions 53A at the input of microchannel plate assembly 63. The gain of the multiplier assembly 63 is controlled by the voltage differential applied between the front surface of plate 64 and the back surface of plate 65. This voltage differential is provided by power supply 68. The output current 66A collected by anode 67A flows to the input 69A of amplifier 70A. The gain of amplifier 70A is controlled by a reference voltage from gain control supply 72A provided at the gain control input 71A of amplifier 70A. The amplified signal at the output of the amplifier 70A is provided to the input 73A of a fast ADC 78A, which converts the analog signal to a sequence of digital values corresponding to the amplitude of the signal as a function of time. The array of digital values therefore represents the ion flux 52A arriving at the detector 50 as a function of time, which is easily interpreted as the m/z spectrum of ions in the ion population. A number of such spectra may be integrated in integrating memory 80A, in order to improve the signal-to-noise and intensity dynamic range of the spectrum, before being transferred to the memory of computer 101 for digital processing.

Similarly, the output current 86A, corresponding to ions 53A at the microchannel plate assembly 63 input, flows to the input 89A of amplifier 90A. The gain of amplifier 90A is controlled by a reference voltage from gain control supply 92A provided at the gain control input 91A of amplifier 90A. The amplified signal at the output of the amplifier 90A is provided to the input 93A of a discriminator 94A, which compares the amplitude of the signal at input 93A with the amplitude of a reference level provided at threshold reference input 95A, which is adjusted by threshold reference adjustment supply 96A. If the amplitude of the signal at input 93A is greater than the amplitude of the reference level at threshold reference input 95A, then the discriminator 94A produces an output pulse, which is provided to the input 97A of the TDC 98A. If the amplitude of the signal at input 93A is less than the amplitude of the reference level at threshold reference input 95A, then the discriminator 94A produces no output pulse, which is also sensed at the input 97A of the TDC 98A. The TDC 98A continually senses whether a pulse has occurred at each increment or cycle of a clock or timer. If the discriminator produces a pulse at any clock cycle, the time of the pulse relative to some start time is registered, and the corresponding time bin in a histogram memory array is incremented by one. The start time of the clock typically corresponds to the time of pulse acceleration of the ions into the ToF drift region, so the time recorded by the TDC 98A corresponds to the flight time of ions in the ToF mass spectrometer. A number of such spectra are typically integrated in histogram integrating memory 100A to produce a histogram corresponding to an average ToF spectrum, before the spectrum is transferred to the memory of computer 101.

As illustrated in FIG. 9, additional detectors, such as detector 51 in FIG. 9, may be configured with multiple anodes, where at least one anode is coupled to a fast ADC acquisition system, and other anodes are coupled separately to individual TDC acquisition systems. Specifically, FIG. 9 depicts detector 51 consisting of a dual channel electron multiplier plate assembly 83, which is comprised of two channel electron multiplier plates 84 and 85 in series, so that, in response to the impact of ions 52B, 53B, 53C, etc., the first plate 84 produces an amplified output current which is further amplified by the second plate 85. This second detector 51 is configured with a multiplicity of collector anodes, anode 67B, anode 87B, anode 87C, etc., which collect the corresponding output currents 66B, 86B, 86C, etc., respectively, of the second microchannel plate electron multiplier 85, resulting from the impact of ions 52B, 53B, 53C, etc., respectively. The gain of the multiplier assembly is controlled by the voltage differential applied between the front surface of plate 84 and the back surface of plate 85. This voltage differential is provided by power supply 88. The output currents 66B, 86B, 86C, etc., collected respectively by anodes 67B, 87B, 87C, etc., are directed to the inputs 69B, 89B, 89C, etc., of amplifiers 70B, 90B, 90C, etc., respectively. The gains of amplifiers 70B, 90B, 90C, etc. are controlled by reference voltages from gain control supplies 72B, 92B, 92C, etc., provided at the gain control inputs 71B, 91B, 91C, etc., of amplifiers 70B, 90B, 90C, etc., respectively.

The amplified signal at the output of the amplifier 70B is provided to the input 73B of a fast ADC 78B, which converts the analog signal to a sequence of digital values corresponding to the amplitude of the signal as a function of time. The array of digital values therefore represents the ion flux 52B arriving at the detector 51 as a function of time, which is easily interpreted as the m/z spectrum of ions in the ion population. A number of such spectra may be integrated in integrating memory 80B, in order to improve the signal-to-noise and intensity dynamic range of the spectrum, before being transferred to the memory of computer 101 for digital processing.

The amplified signals at the outputs of the amplifiers 90B, 90C, etc., are provided to the inputs 93B, 93C, etc., of discriminators 94B, 94C, etc., which compare the amplitudes of the signals at inputs 93B, 93C, etc., with the amplitudes of reference levels provided at threshold reference inputs 95B, 95C, etc., which are adjusted by threshold reference adjustment supplies 95B, 95C, etc., respectively. If the amplitude of the signal at any input 93B, or 93C, etc., is greater than the amplitude of the reference level at threshold reference input 95B, or 95C, etc., respectively, then the discriminator 94B, or 94C, etc., produces an output pulse, which is provided to the input 97B, or 97C, etc., of a TDC 98B, or 98C, etc., respectively. If the amplitude of the signal at input 93B, or 93C, etc., is less than the amplitude of the reference level at threshold reference input 95B, or 95C, etc., respectively, then the discriminator 94B, or 94C, etc., produces no output pulse, which is also sensed at the input 97B, or 97C, etc., of the TDC 98B, or 98C, etc., respectively. The TDC 986, 98C, etc. continually sense whether a pulse has occurred at each increment or cycle of a clock or timer. If any discriminator produces a pulse at any clock cycle, the time of the pulse relative to some start time is registered, and the corresponding time bin in a histogram memory array, shared among all TDC's, is incremented by one. The start time of the clock typically corresponds to the time of pulse acceleration of the ions into the ToF drift region, so the time recorded by any TDC corresponds to the flight time of ions in the ToF mass spectrometer. A number of such spectra are typically integrated in histogram integrating memory 100B to produce a histogram corresponding to an average ToF spectrum, before the spectrum is transferred to the memory of computer 101.

The spectral information from the multiple acquisition systems of both detectors may be integrated in the computer 101 in real time during data acquisition, or after data recording, to produce a composite integrated spectrum.

Because each detector 50 and 51 and their associated electronics may be operated completely independently, the operation of each detection system may be optimized separately with respect to dynamic range, temporal resolving power, and/or signal-to-noise. According to this preferred method of operation of the present invention, the gain of multiplier 63 of detector 50 may be adjusted by adjusting multiplier differential supply 68 to a low enough value to ensure that the greatest number of simultaneously arriving ions within a m/z spectrum does not produce a multiplier output signal 66A that exceeds the maximum linear dynamic range of the multiplier 63. The gain of the signal amplifier 70A, that couples the output 66A of multiplier 63 collected on anode 67A to fast ADC 78A, may also be adjusted by gain adjustment control 72A to ensure that the maximum signal in the spectrum does not exceed the maximum digitization range of the ADC 78A. With these operating conditions, signals within each individual spectrum may be recorded with amplitudes that vary within a maximum range of 0 to 255 digitizer counts with an 8-bit ADC 78A. However, with these operating conditions, single ion hits may not produce signal amplitudes 66A great enough to register at least 1 ADC count, and therefore may not be detected. Indeed, if the number of simultaneously arriving ions of any particular m/z value is less than the number which results in 1 ADC count, then ions of those m/z values will not be detected with these gain settings of the multiplier 63 and amplifier 70A. However, single ion hits may be recorded with detector 50 by utilizing the TDC 98A as described above. In order to ensure sufficient detection efficiency for single ion hits with the multiplier 63 gain reduced so as to avoid saturation of the ADC 98A, the gain of amplifier 90A may be increased by adjusting the reference voltage from gain control supply 92A provided at the gain control input 91A of amplifier 90A.

The gain of the other multiplier 83, and/or the gain of its associated amplifier 70B, may be adjusted to higher levels than those of the multiplier 63 and/or amplifier 70A, so that fewer simultaneously arriving ions produce the maximum ADC count of the ADC 78B, than are necessary to produce the maximum ADC count of the ADC 78A. With these settings of gains for multipliers 83 and 63, and their respective amplifiers 70B and 70A, then, a fewer number of simultaneously arriving ions will produce a signal amplitude that is large enough to correspond to more than 1 count in the ADC, and therefore be detected, with detector 50 than are required with detector 51. Of course, larger signal amplitudes in the spectrum will exceed the linear dynamic range of detector 51 and/or the maximum count of the ADC 78B, but detector 50 owing to the reduced gain of multiplier 63 and/or amplifier 70A relative to that of multiplier 83 and/or amplifier 70B would properly measure these largest signal amplitudes. By properly scaling the amplitudes of the m/z peaks in each detector's spectrum and combining the two spectra into one composite spectrum, the resulting spectrum may exhibit a signal dynamic range that is greater than would be possible with prior art single detectors coupled to a fast ADC. Proper scaling of the peak amplitudes in each spectrum is straightforward because some peaks in the m/z spectrum will typically be within the dynamic range of both detection systems, or at least the adjustment of gains may be performed in order to ensure that the amplitudes of some m/z peaks in the spectrum fall within the dynamic range of both detectors, allowing an unambiguous cross calibration of peak amplitudes between the two spectra. Additional detectors with additional ADC acquisition systems may be incorporated in the overall detector configuration, and may be operated at different settings of the multiplier and/or amplifier gain so as to extend the signal dynamic range capability even further.

Single ion hits may be recorded with detector 51 by utilizing the TDC's 98B, 98C, etc. as described above. In order to ensure sufficient detection efficiency for single ion hits, the gains of amplifiers 90B, 90C, etc. may be increased by adjusting the reference voltage from gain control supplies 92B, 92C, etc. provided at the gain control inputs 91B, 91C, etc. of amplifiers 90B, 90C, etc., respectively.

The spectral information from all anodes coupled to TDC acquisition systems within all detectors may be combined, and, for those ion m/z values with intensities low enough to allow valid single-ion counting with a TDC, arrival times may be measured with greater precision and accuracy with the TDC's 98A, 98B, 98C, etc., than with typical fast ADC's 78A and 78B, resulting in improved m/z ToF resolving power and measurement accuracy for those low-intensity ions in the resulting integrated spectrum. Furthermore, the multiple anodes and TDC acquisition systems provide extended dynamic range for low-amplitude signals relative to a single anode and TDC acquisition system. Therefore, the gains of the amplifiers coupling the other anodes to the ADC acquisition systems may be reduced, thereby extending the range of signal amplitudes that may be measured by the ADC acquisitions to greater signal amplitudes, because the ADC acquisition systems would not need to record the low-amplitude signals that are recorded by the multiple TDC acquisition systems. Alternatively, the overlap in dynamic range between the TDC acquisition systems and the ADC acquisitions allows a cross-calibration between these two types of acquisition systems with respect to signal amplitude and time scale. Also, the greater time precision of the TDC approach may provide better arrival time information even for the simultaneous arrival of multiple ions at other m/z values than the fast ADC acquisition systems, thereby enhancing the precision and accuracy of all measured m/z values.

Therefore, this embodiment of the present invention allows both single-ion and multiple-ion amplitude information, obtained from multiple detectors coupled to multiple ADC and multiple TDC acquisition systems, to be combined with the more precise arrival time information and better signal-to-noise of the TDC acquisition systems, the result being that m/z ToF spectra may be produced with greater dynamic range, time resolution, and signal-to-noise than is possible with the prior art detection systems. Furthermore, although FIG. 9 illustrates only two detectors configured this way, it should be understood that any number of detectors may be configured similarly within the scope of this embodiment of the present invention.

It will be understood that, for all of the possible implementations and methods of dual detector arrangements, the number of spectra integrated by one detector, for example, detector 50 in FIG. 6, can be different from the number of spectra integrated by the other detector, for example detector 51 in FIG. 6. For example, if detector 51 is employed to measure low intensity m/z peaks with relatively high gain, while detector 50 is employed to measure high intensity m/z peaks with relatively low gain, the resulting signal-to-noise will be improved if the total number of integrated spectra in the composite spectrum is divided unequally between the two detector such that number of spectra integrated from detector 51 is greater than that from detector 50.

It should be understood that the preferred embodiment was described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly legally and equitably entitled.

What is claimed is:

1. A particle detection system comprising:

(a) a mass analyzer;

(b) at least two independent particle detectors, each of said detectors being positioned so as to be physically separated in space, wherein at least two of said independent detectors are controlled independently such that a gain of one of the two detectors is adjustable independent of a gain of the other detector, wherein each of the detectors comprises an electron multiplier, the gain of each detector being controlled by varying a voltage applied to the electron multiplier of the corresponding detector independent of the voltage applied to electron multipliers of other detectors thereby improving resolving power, signal-to-noise, or dynamic range of the detection system relative to the system in which the gains of the two detectors are not independently adjustable;

wherein each of said two independent particle detectors is configured to detect ions comprising a portion of a sample population of ions following mass analysis of said sample population of ions by said mass analyzer, whereby each of said particle detectors in said mass analyzer is configured to detect ions of more than one mass-to-charge value, such that said mass analysis is performed essentially identically by said mass analyzer for each said portion of said sample population of ions, wherein any of said portions may include a plurality of ions of one or more ion species, wherein said portions are directed by said mass analyzer to said detectors, respectively, such that at least one mass-to-charge value is detectable essentially simultaneously by each of said at least two detectors, and whereby at least one output signal is produced by each of said detectors upon impingement of said ions on said detectors; and (c) at least one signal recorder, whereby said output signals are recorded.

2. The particle detection system of claim 1, further comprising at least one signal amplifier, whereby said at least one output signal produced by each said detector is amplified separately.

3. The particle detection system of claim 1, further comprising a means for directing ions to impinge on at least one of said at least one detector.

4. The particle detection system of claim 3, wherein said ion directing means is selected from the group consisting of an electrostatic device and a magnetic deflection device.

5. The particle detection system of claim 1, wherein any of said at least two detectors comprises at least one of a charge collector electrode; a conversion dynode coupled to the corresponding electron multiplier.

6. The particle detection system of claim 1, wherein said mass analyzer is selected from the group consisting of: a time-of-flight mass analyzer, a three-dimensional ion trap mass analyzer, a quadrupole mass filter, a two-dimensional ion trap with radial ejection mass analyzer, and a two-dimensional ion trap with axial ejection mass analyzer.

7. The particle detection system of claim 1, wherein at least one of said signal recorders comprises an analog-to-digital converter.

8. The particle detection system of claim 1, wherein at least one of said signal recorders comprises a time-to-digital converter.

9. The particle detection system of claim 1, wherein said at least one signal recorder comprises means for combining said at least one output signal into a composite signal record.

10. The particle detection system of claim 1, further comprising at least one signal selector switch, whereby one said output signal or another is selected for recording.

11. A method of operating the particle detection system of any of claims 1-8, said method comprising the step of: alternately recording signals from a first, then a second, and then any third, fourth, etc. sets of at least one detector during a first, second, and any third, fourth, etc., respectively, period of time.

12. A method of operating the particle detection system of any of claims 1-8, said method comprising the step of: recording signals simultaneously from at least two of said detectors for a period of time.

13. A method of operating the particle detection system of any of claims 1-10, said method comprising the step of: setting the gain of each of said detectors separately and independent of said gains of any other of said detectors.

14. A method of operating the particle detection system of claim 2, said method comprising the step of: setting the gain of each of said signal amplifiers separately and independent of the gains of any other of said signal amplifiers.

15. A method of operating the particle detection system of claim 10, said method comprising the step of: controlling said at least one signal selector switch to select one said output signal from at least two said output signals for recording by at least one signal recorder.

16. A method of operating the particle detection system of claim 3, said method comprising the step of: alternately directing ions with said ion deflection means toward a first, then a second, and then any third, fourth, etc. sets of at least one detector during a first, second, and any third, fourth, etc., respectively, period of time.

17. A method of operating the particle detection system of claim 3, said method comprising the step of: directing ions with said ion deflection means toward at least two of said detectors simultaneously for a period of time.

18. The particle detection system of claim 1, wherein the gain of the at least one detectors is set so that the particle detection system has a linear dynamic range that is greater than a linear dynamic range of each detector individually.

19. The particle detection system of claim 1, wherein each of the electron multipliers comprises two plates, the gain of each detector being controlled by a voltage differential applied to different surfaces of the plates.

20. The particle detection system of claim 1, wherein one of the at least one signal recorders comprises an analogue-to-digital converter configured to receive an output signal produced by one of the detectors.

21. The particle detection system of claim 20, wherein another of the at least one signal recorders comprises a time-to-digital converter configured to receive an output signal produced by another one of the detectors.

22. A mass spectrometry system, comprising:

an ion source;

an ion guide; and the particle detection system of claim 1, wherein during operation of the mass spectrometry system, the ion guide receives ions from the ion source and directs the ions towards the particle detection system.

23. The mass spectrometry system of claim 18, wherein the mass spectroscopy system is a Time-of-flight mass spectrometry system.

24. The particle detection system of claim 1, wherein at least two of said portions each comprises an ion population having essentially the same mass-to-charge values as the mass-to-charge values of said sample population of ions.

25. A particle detection system comprising:

(a) a mass analyzer; and (b) at least two independent particle detectors wherein:

each of the detectors comprises an electron multiplier;

the electron multiplier of each detector is electrically isolated from the electron multiplier of each of the other detectors;

the gain of each detector is adjustable by varying a voltage applied to the electron multiplier of the detector so that the resolving power, signal-to-noise, or dynamic range of the detection system is improved relative to the system in which the gains of the two detectors are not independently adjustable;

each of the detectors has its independent electrical controls to provide an amplified electrical signal indicative of a portion of a sample population of ions;

each of the detector is configured to detect ions of more than one mass-to-charge value, such that a mass analysis is performed essentially identically by the mass analyzer for each of the portions of the sample population of ions; and at least one output signal is produced by each detector upon impingement of the ions on the detectors.

* * * * *